US011707689B2

(12) United States Patent
Metni et al.

(10) Patent No.: US 11,707,689 B2
(45) Date of Patent: Jul. 25, 2023

(54) RECIRCULATING VERTICAL WIND TUNNEL

(71) Applicant: Skyventure International (UK) Ltd., Worcester (GB)

(72) Inventors: N. Alan Metni, Austin, TX (US); Justin Eugene Waldron, Austin, TX (US); Wade Austin Lewis, Austin, TX (US); Mark Arlitt, Austin, TX (US)

(73) Assignee: IFLY HOLDINGS, LLC, Austin, TX (US)

( * ) Notice: Subject to any disclaimer, the term of this patent is extended or adjusted under 35 U.S.C. 154(b) by 0 days.

(21) Appl. No.: 17/290,402

(22) PCT Filed: Nov. 16, 2019

(86) PCT No.: PCT/IB2019/059857
§ 371 (c)(1),
(2) Date: Apr. 30, 2021

(87) PCT Pub. No.: WO2020/100120
PCT Pub. Date: May 22, 2020

(65) Prior Publication Data

US 2022/0001288 A1 Jan. 6, 2022

Related U.S. Application Data

(60) Provisional application No. 62/768,384, filed on Nov. 16, 2018, provisional application No. 62/929,260, filed on Nov. 1, 2019.

(51) Int. Cl.
*A63G 31/00* (2006.01)
*G01M 9/00* (2006.01)

(52) U.S. Cl.
CPC ..... *A63G 31/00* (2013.01); *A63G 2031/005* (2013.01)

(58) Field of Classification Search
CPC ..... A63G 31/00; G09B 9/00; G09B 9/16; G01M 9/00
(Continued)

(56) References Cited

U.S. PATENT DOCUMENTS 1,811,364 A 6/1931 Olshevsky
3,109,670 A 11/1963 Engel
(Continued)

FOREIGN PATENT DOCUMENTS

BR PI9702554-2 A 3/1999
CN 201281652 Y 7/2009
(Continued)

OTHER PUBLICATIONS

Koss, Holger; Climatic Wind Tunnel, Civil Engineering & Architectural Aerodynamics (CEAero); May 2014.
(Continued)

*Primary Examiner* — Kien T Nguyen
(74) *Attorney, Agent, or Firm* — Polson Intellectual Property Law, PC

(57) ABSTRACT

A vertical wind tunnel for indoor skydiving having at least one recirculating airflow plenum. The airflow plenum includes a first vertical member housing a flight chamber, a top horizontal member, a second vertical member, and a bottom horizontal member. The bottom horizontal member has a first section and a second section. A corner section connects the second section of the bottom horizontal member with the first vertical member. The second section of the bottom horizontal member contracts the airflow travelling through the bottom horizontal member between the first section and its exit to the corner section. The corner section further contracts the airflow exiting the second section of the bottom horizontal member towards the first vertical member.

24 Claims, 20 Drawing Sheets

(58) Field of Classification Search
USPC ..... 472/49–50, 137
See application file for complete search history.

(56) References Cited

U.S. PATENT DOCUMENTS

| | | | | |
|---|---|---|---|---|
| 3,484,953 | A | 12/1969 | Norheim, Jr. | |
| 4,457,509 | A | 7/1984 | St-Germain | |
| 5,099,685 | A | 3/1992 | McLean et al. | |
| 5,495,754 | A | 3/1996 | Starr, Jr. et al. | |
| 5,655,909 | A | 8/1997 | Kitchen et al. | |
| 6,083,110 | A | 7/2000 | Kitchen et al. | |
| 7,153,136 | B2 | 12/2006 | Hatlestad et al. | |
| 7,156,744 | B2 | 1/2007 | Metni et al. | |
| 7,640,796 | B2 | 1/2010 | Petruk | |
| 7,819,664 | B2 | 10/2010 | Petruk | |
| 7,926,339 | B2 | 4/2011 | Serrano Pellicer | |
| 8,668,497 | B2 * | 3/2014 | Nebe | A63G 31/00 434/247 |
| 9,045,232 | B1 | 6/2015 | Burke et al. | |
| 9,194,632 | B2 | 11/2015 | Metni et al. | |
| 9,327,202 | B2 | 5/2016 | Lurie | |
| D770,383 | S | 11/2016 | Lurie et al. | |
| 10,238,980 | B2 | 3/2019 | Romanenko et al. | |
| 10,765,958 | B2 | 9/2020 | Maida et al. | |
| 11,058,960 | B2 | 7/2021 | Metni et al. | |
| 2011/0100109 | A1 | 5/2011 | Kim et al. | |
| 2015/0375125 | A1 | 12/2015 | Lurie | |
| 2018/0050276 | A1 | 2/2018 | Romanenko et al. | |
| 2019/0001229 | A1 * | 1/2019 | Arias, IV | A63G 31/00 |
| 2020/0324213 | A1 | 10/2020 | Metni et al. | |

FOREIGN PATENT DOCUMENTS

| | | | |
|---|---|---|---|
| CN | 201492925 | U | 6/2010 |
| CN | 202393581 | U | 8/2012 |
| CN | 202420815 | U | 9/2012 |
| CN | 302446241 | S | 5/2013 |
| CN | 302446242 | S | 5/2013 |
| CN | 302446243 | S | 5/2013 |
| CN | 302446244 | S | 5/2013 |
| CN | 105854304 | A | 8/2016 |
| CN | 112717428 | A | 4/2021 |
| DE | 3007950 | A1 | 9/1981 |
| FR | 2659620 | A1 | 9/1991 |
| GB | 2062557 | A | 5/1981 |
| JP | 02-036887 | | 2/1990 |
| JP | 02-036887 | | 6/1990 |
| JP | H03-1361289 | A | 6/1991 |
| JP | H03-116883 | | 12/1991 |
| JP | 6-296764 | | 10/1994 |
| JP | 8-182787 | | 7/1996 |
| JP | H08-182791 | A | 7/1996 |
| JP | 8-299515 | | 11/1996 |
| JP | 8-299516 | | 11/1996 |
| JP | H08-299516 | A | 11/1996 |
| JP | 10-082715 | | 3/1998 |
| JP | 10-156047 | | 6/1998 |
| JP | 10-234919 | | 9/1998 |
| JP | 10-311774 | A | 11/1998 |
| JP | 10-314359 | | 12/1998 |
| JP | 11-42308 | | 2/1999 |
| JP | 2008-076304 | A | 4/2008 |
| LV | 14423 | B | 1/2012 |
| NZ | 568424 | A | 3/2010 |
| WO | 0059595 | A1 | 10/2000 |
| WO | 2010028980 | A1 | 3/2010 |
| WO | 2011044860 | A1 | 4/2011 |
| WO | 2011084114 | A2 | 7/2011 |
| WO | 2015185124 | A1 | 12/2015 |
| WO | 2016170365 | A2 | 10/2016 |
| WO | 2016180735 | A1 | 11/2016 |
| WO | 2017006251 | A1 | 1/2017 |
| WO | 2017098411 | A1 | 6/2017 |
| WO | 2017103768 | A2 | 6/2017 |
| WO | 2018015766 | A1 | 1/2018 |
| WO | 2018122575 | A1 | 7/2018 |
| WO | 2019021056 | A1 | 1/2019 |
| WO | 2019082115 | A1 | 5/2019 |
| WO | 2020067917 | A1 | 4/2020 |

OTHER PUBLICATIONS

Lindgren, Bjorn et al.; Evaluation of a New Wind-Tunnel with Expanding Corners; Royal Institute of Technology pepartment of Mechanics SE-1 00 44 Stockholm, Sweden; Oct. 2003.

Wenzinger, Carl J. and Harris, Thomas A.: "The Vertical Wind Tunnel of the National Advisory Committee for Aeronautics", National Advisory Committee for Aeronautics, Report No. 387, Feb. 1931.

Defrance, Smith J : "The N.A.C.A. Full-Scale Wind Tunnel", National Advisory Committee for Aeronautics, Mar. 1933.

Rossow, Vernon J.; Schmidt, Gene I.; Meyn, Larry A.; Ortner, Kimberley R.; and Holmes, Robert E.: "Aerodynamic Characterics of an Air-Exchanger System for the 40-by 80-Foot Wind Tunnel al Ames Research Center", NASA TM 88192, Jan. 1986, pp. 4, 29 and 33.

Pope, Alan and Harper, John J : "Low-Speed Wind Tunnel Testing" John Wiley & Sons, Inc., 1966, pp. 6-7 and 75-76.

Wolf, T.: "Improvement and Modernization of Subsonic Wind Tunnels", Journal of Aircraft, vol. 30, No. 1, Jan.-Feb. 1993.

DD Form 139lc Army, FY 1985 Military Construction Project Data, dated Dec. 12, 1984, Ft. Bragg, NC, Titled: Unspecified Minor Construction Free Fall Simulation Facility, Project No. T897.

Neihouse, A.I., "Design and Operation Techniques of Vertical Spin Tunnels", AGARD Memorandum, Nov. 6, 1954.

Hiscocks et al, "Report on Bivis to Luftfahrtforschungsanstant Hermann Goring, Volkenrode Brunswick", B.I.O.S. Final Report No. 160, 1945.

"8-Food Transonic Wind Tunnel", CALSPAN Report No. WTO-300, Oct. 1971.

Photos from NASA website of Langley Wind Tunnel (http://crgis.ndc.nasa.gov/historic/File:15ft._and_20ft._Spin_Tun.ipg).

Wind Tunnels of NASA, Chapter 4 (http://history.nasa.gov/SP-440/ch4-7.htm). Website accessed Apr. 8, 2015.

"Vertical Wind Tunnel", LIFE Magazine, Aug. 8, 1949, p. 55-57.

"Wright-Patterson Air Force Base, Area B, Building 27, Verical Wind Tunnel", HAER No. OH-79-A, Historical American Engineering Record.

Garner et al, "Subsonic Wind Tunnel Wall Corrections", Advisory Group for Aerospace Research & Development, AGARDograph 109, Oct. 1966.

Spiegel et al. "A Description of the Ames 2-by-2 foot Transonic Wind Tunnel and Preliminary Evaluation of Wall Interference", National Advisory Committee for Aeronautics, NACA Research Memorandum, Jan. 20, 1956.

Website for Vegas Indoor Skydiving, http://www.vegasindoorskydiving.com.

Neihouse et al, "Status of Spin Research for Recent Airplane Designs" Langley Research Center Technical Report R-57.

Goodrich et al, "Wind Tunnels of the Eastern Hemisphere", Library of Congress, Aug. 2008.

Troller, "The Daniel Guggenheim Airship Institute", Journal of Applied Physics, Vo9. 9, No. 1, Jan. 1938.

Wright-Patterson Air Force Base Vertical Wind Tunnel diagrams, 1944.

Baggett, "You float on air in this new-sport flight chamber", Popular SCience, Mar. 1983.

Zell, "Performance and Test Section Flow Characteristics of the National Full-Scale Aerodynamic Complex 80-by-120-Foot Wind Tunnel", NASA Technical Memorandum 103920, Jan. 1993.

World Directory of Aerospace Research and Development, US General Accounting Office, Jan. 22, 1990.

"Technical Guide for the Kirsten Wind Tunnel", University of Washington Aeronautical Laboratory, Apr. 2002.

"NASA Langley's 30-by-60-Fott Tunnel", NASA Facts, Oct. 1995.

Design drawings—NACA Wind Tunnel, 1928.

(56) References Cited

OTHER PUBLICATIONS

Mehta et al, "Technical Notes: Design rules for small low speed wind tunnels", The Aeronautical Journal of the Royal Aeronautical Society, Nov. 1979.
Martinez, "The Texas A&M University Low Speed Wind Tunnel", The Wind Tunnel Connection, vol. 1, Issue 3, Mar. 2001.
Schmidt et al, "One-fiftieth Scale Model Studies of 40-by-80-Foot and 80-by-120-Foot Wind Tunnel Complex at NASA Ames Research Center", NASA Technical Memorandum 89405, Apr. 1987.
NASA, "The Wandering Wind Tunnel", https://www.grc.nasa.gov/WWW/K-12/WindTunnel/wandering_windtunnel.html.
"Wind Tunnel Explained with Computational Fluid Dynamics", Symscape, (https://www.symscape.com/blog/wind-tunnel-explained-with-computational-fluid-dynamics), Jun. 28, 2013.
Pankhurst et al, "Wind-Tunnel Technique", London: Sir Isaac Pitman & Sons, Ltd., 1952.
Bradshaw et al, "Wind Tunnel Design: Corner Vanes" (http://navier.stanford.edu/bradshaw/tunnel/cornervane.html). Website accessed Jul. 22, 2013.
Gorlin et al, "Wind Tunnels and their Instrumentation" (translate3d from Russian), Israel Program for Scientific Translations.
Boethert, "Transonic Wind Tunnel Testing", Advisory Group for Aerospace Research & Development,, AGARDograph 49, 1961 (in three parts).
Examination report dated Jul. 18, 2022 in related Australian application No. 2019378252.
Examination report dated Sep. 07.2022 in related India application No. 202117021550.
Examination report dated Feb. 1, 2023 in related Taiwan application No. 108141836.

* cited by examiner

RECIRCULATING VERTICAL WIND TUNNEL

BACKGROUND

The present disclosure relates to recirculating vertical wind tunnels, and in particular, tunnels for indoor skydiving. These tunnels recreate the experience of outdoor skydiving in a safe and controlled indoor environment. However, recirculating vertical wind tunnels are often quite expensive to build and operate, and require a substantial amount of space to generate an airflow that is strong enough to suspend one or more persons, within acceptable levels of noise and energy consumption, while also maintaining a consistent quality airflow. It is often desirable that the airflow through the flight chamber is substantially uniform with low turbulence. Moving in the direction of airflow, recirculating vertical wind tunnels generally comprise a flight chamber, a diffuser above the flight chamber, a first corner or turn, an upper horizontal plenum, a second corner or turn, a vertical return plenum, a third corner or turn, a lower horizontal plenum, a fourth corner or turn, and an inlet contractor—also referred to as a contracting duct or jet nozzle—below the flight chamber. Tunnels have been designed with a single flowpath loop or a plurality of flowpath loops, in which case the different airflow pathways typically diverge downstream from the flight chamber (e.g., at or near the first corner) and then converge again upstream from the flight chamber (e.g., at or near the fourth corner).

Some recirculating vertical tunnel facilities install the bottom portions of the tunnel structure (e.g., the bottom corners, lower horizontal plenum, inlet contractor, lower part of the vertical return plenum) underground such that the flight chamber is at or near ground level. In this way, the structural integrity of the tunnel may be augmented while also avoiding the necessity of arranging the flight chamber on an upper floor of the facility, which can decrease commercial visibility/accessibility and increase associated building costs. This design approach may also allow a facility to comply with local building height restrictions. Further, positioning at least a portion of the flowpath circuit underground can help to absorb heat and noise from the tunnel. Due to the dimensional requirements of many recirculating vertical wind tunnel designs, however, substantial underground excavation is generally required to lay the necessary foundation if the flight chamber will be at or near ground level. For example, the height between the base of the flight chamber and the base of the lower horizontal plenum may be approximately 25 feet (7.6 m) or more in some designs. Construction costs and project timeframes will typically increase linearly with the length and width of the excavation, but exponentially with the depth of the excavation. Cost and time requirements may be further amplified depending on the local soil composition and moisture content. Technical challenges also arise with increasing excavation depth as well, including accounting for the heightened risks of water infiltration and collapse from the higher lateral pressure exerted by surrounding terrain at deeper locations. Further, it may be difficult or cost prohibitive to achieve a desired depth due to shallow bedrock in some locations. In laying the structure foundation, conventional approaches have typically used poured cement to form the bottom portions of the wind tunnel, which generally results in simple geometries defining the flowpath cross section compared to preformed fabrications having custom-designed geometries produced from different materials, in order to reduce construction costs. What is needed is a recirculating vertical wind tunnel with a reduced height between the flight chamber and the base of the flowpath structure, with minimal impact to tunnel efficiency or the quality of airflow for indoor skydiving.

Moreover, wind tunnels generally have a cable floor assembly or structure to provide support to users standing within the flight chamber, while also allowing the airflow to pass through to suspend users during indoor skydiving. In many tunnels, the cables are mounted to a plurality of weldments arranged around the periphery of the flight chamber. The weldments are typically supported by separate load-bearing crossbeams or other elements of the facility structure, which can increase construction costs. The cables often have varying sizes to minimize the required horizontal footprint of the weldments around the flight chamber, since many flight chambers are circular or substantially circular in cross section, meaning a cable through an edge of the flight chamber does not need to be as long as a cable through the center diameter of the flight chamber. The weldments generally have a removeable top cover to access the ends of the cables securely mounted within the weldments. Therefore, such designs are typically installed, replaced, and maintained from above by workers on the commercial level of the facility (e.g., the observation area or staging chamber surrounding the flight chamber). Because the cables extend across the flight chamber and mount within the weldments, the inside of the weldments are often in aerodynamic communication with the tunnel flowpath. To prevent noise infiltration to the commercial areas surrounding the flight chamber through the weldments, the top covers are usually sealed to prevent customers from being exposed to the high decibel levels inside the wind tunnel. Such designs have relatively expensive component fabrication costs; subjectively less aesthetic appeal due to visible access covers surrounding the flight chamber; a relatively lengthy, complicated, and arduous installation/maintenance process, which increases labor costs and project timeframes; and a limited range of possible suppliers due to complexity from the requirements.

Another consideration in wind tunnel design and construction is the horizontal dimensional requirements of the flowpath. For example, some locations may not have the necessary space or footprint available to accommodate the horizontal length dimensional requirements of a particular wind tunnel design. In this sense, a smaller location may not be feasible for wind tunnel construction. What is needed is a recirculating vertical wind tunnel with a reduced dimensional requirement along the length of the flowpath structure.

The foregoing discussion of the related art and any limitations therewith are intended to be illustrative and not exclusive. Other limitations of the related art will become apparent to those of skill in the art upon review of the specification and drawings.

SUMMARY

The following embodiments and aspects thereof are described and illustrated in conjunction with systems, tools and methods which are meant to be illustrative, not limiting in scope. In various embodiments, one or more described problems have been reduced or eliminated, while other embodiments are directed to other improvements.

The present disclosure relates to a recirculating vertical wind tunnel design. One aspect is to reduce the vertical distance or height between the base of the flight chamber and the base of the fourth corner and/or lower horizontal plenum. Another aspect is to merge the inlet contractor and the fourth corner under the flight chamber into a single structure and airflow path element. Another aspect is to decrease the construction costs and time requirements associated with depth excavation when the flight chamber is to be arranged at or near ground level. Another aspect is efficient power consumption to reduce the operational costs of the tunnel. Another aspect is to minimize turbulence, friction, and pressure loss within such a wind tunnel. Another aspect is to provide an airflow inside the flight chamber that is at least comparable in quality to prior tunnel designs with respect to uniformity and turbulence.

These aspects may be satisfied by a vertical wind tunnel for indoor skydiving, comprising:

at least one recirculating airflow plenum, the airflow plenum including a first vertical member, a top horizontal member, a second vertical member, and a bottom horizontal member;

means for providing an airstream flowing through the airflow plenum and in the first vertical member in an upward direction;

a flight chamber housed within the first vertical member of the airflow plenum;

a corner section connecting the bottom horizontal member with the first vertical member;

wherein the bottom horizontal member has a first section and a second section, the bottom horizontal member extending from the second vertical member to the first vertical member, the first section connected to the second vertical member and the second section connected to the corner section connecting the bottom horizontal member to the first vertical member;

the second section of the bottom horizontal member contracting the airflow travelling through the bottom horizontal member between the first section and its exit to the corner section;

the corner section further contracting the airflow exiting the second section of the bottom horizontal member towards the first vertical member.

By providing a corner section, which connects at least one bottom horizontal member to a first vertical member with its flight chamber, with a design such that the airstream travelling through it is contracted, the overall height of such a vertical wind tunnel can be significantly reduced. Then the necessary inlet contractor upstream to the flight chamber is provided by the corner section. Therefore, the bottom of the flight chamber can be arranged much lower than in prior art tunnels of this kind. The bottom of the flight chamber may thus be arranged at the very bottom of the first vertical member. In order to provide a smooth airstream contraction, this vertical wind tunnel provides a dual stage contraction, which two contraction steps do not necessarily need to be separated from each other but can be continuous. One contraction zone is arranged in the corner section at the bottom of the first vertical member, and an upstream contraction section is arranged within the bottom horizontal member.

We believe this is the first time that it is suggested to use the corner section at the bottom of the first vertical member with its flight chamber as the inlet contractor.

The benefits of the present disclosure can be achieved with tunnels having one single return airflow plenum or having more than one return airflow plenum, for example two airflow plenums, for example arranged in relation to the first vertical member at opposite sides thereof. Further, the benefits of the present disclosure can be achieved irrespective of where in the return airflow plenum the means for providing the airstream, the fan assembly, is arranged. The fan assembly could be arranged in the top horizontal member. It is also possible to arrange the fan assembly in the second vertical member, in particular in its upper section.

In order to reduce turbulences within the contracting corner section, it is possible to arrange a set of turning vanes in the corner section which redirect the airstream entering the corner section streaming horizontally into a direction towards the flight chamber within the first vertical member. Depending on the length of guidance that the turning vanes provide to the airstream, it is possible that shorter turning vanes in the direction of the travel of the airstream are arranged within the corner section. Two or more sets of turning vanes may also be used depending on the tunnel configuration. The turning vanes may be arranged within an arch-like section of the corner section, which arch section typically provides part of the plenum walls. This arch section is preferably curved in the direction of curvature that the airstream is redirected in the corner section.

In some embodiments, another measure to reduce turbulences while redirecting and contracting the airstream in the corner section is to provide a ridge in the bottom section. This ridge functions like a turning vane redirecting the flow of at least a lower part of the airstream entering into the corner section. In case the tunnel has two return airflow plenums arranged opposite to each other with respect to the first vertical member, then two ridges may be arranged typically abutting each other with their backsides and arranged in alignment with a vertical center line through the flight chamber in the first vertical member. This means that the two ridges are arranged in the projection of the middle of the flight chamber with their center. The two ridge may be separate components, provided by a single component, or integrally formed in the plenum wall at this location, for example.

Numerous further aspects of the wind tunnel are disclosed in the following. All features described and disclosed in the specific embodiments can also be used independently from each other. This shall mean that the individual features and benefits of each feature, even if described together with other features, can also be achieved without necessarily needing the other features disclosed in combination with that feature.

Another aspect is to provide a cable floor assembly or structure with reduced fabrication costs for the constituent assembly components. Another aspect is to provide a cable floor assembly which reduces the construction costs of the larger wind tunnel facility building. Another aspect is to simplify and decrease the time required for installation of the cable floor assembly. Another aspect is to simplify and decrease the time required for maintenance of the cable floor assembly. Another aspect is to decrease the time to market for a new wind tunnel construction having such a cable floor assembly. Another aspect is to increase the potential supplier pool for the cable floor assembly. Another aspect is to provide a cable floor assembly which enables a streamlined or minimalist aesthetic with respect to the floor surrounding the flight chamber. Another aspect is to provide a cable floor assembly configured for maintenance service from below.

Another aspect is to provide a stepped plenum divergence in a corner of the wind tunnel to reduce the dimensional requirements between corners of the wind tunnel. Another aspect is a stepped plenum divergence in a corner of the wind tunnel to provide adequate spatial clearance for accommodating ducts and/or ducted fans arranged immediately downstream from the corner. Another aspect is a stepped plenum divergence in a corner of the wind tunnel to provide adequate spatial clearance for accommodating other structural elements, such as support columns or beams.

Another aspect is to provide a recirculating vertical wind tunnel wherein the airflow plenum is separated throughout the vertical return member.

Another aspect is to provide a recirculating vertical wind tunnel having a flyer exchange system for controlling participant movement and environment exchange between the flight chamber and the surrounding observation area of the facility.

In addition to aspects and embodiments described above, further aspects and embodiments will become apparent by reference to the accompanying drawings and the detailed description forming a part of this specification.

BRIEF DESCRIPTION OF THE DRAWINGS

This disclosure is described hereinafter with reference to the following figures.

In the sectional views of FIGS. 6, 7, 34 and 35, internal tunnel spaces are generally indicated by diagonal hatching.

Before further explaining the depicted embodiments, it is to be understood that the invention is not limited in its application to the details of the particular arrangements shown, since the invention is capable of other embodiments. It is intended that the embodiments and figures disclosed herein are to be considered illustrative rather than limiting. Also, the terminology used herein is for the purposes of description and not limitation.

DETAILED DESCRIPTION

Figure 1A:
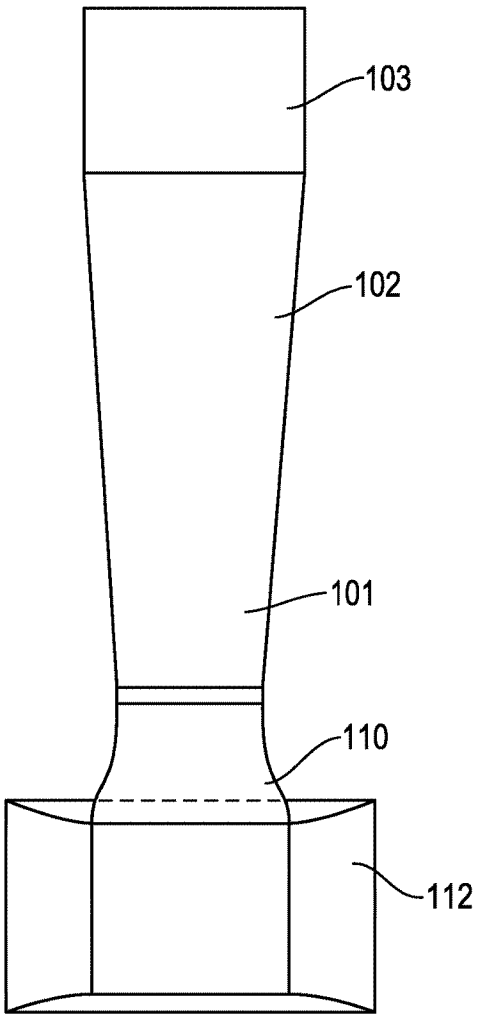
FIG. 1A (prior art)
FIG. 1A shows a sectional view of the wind tunnel of FIG. 1 taken along line A-A.
Figure 1:
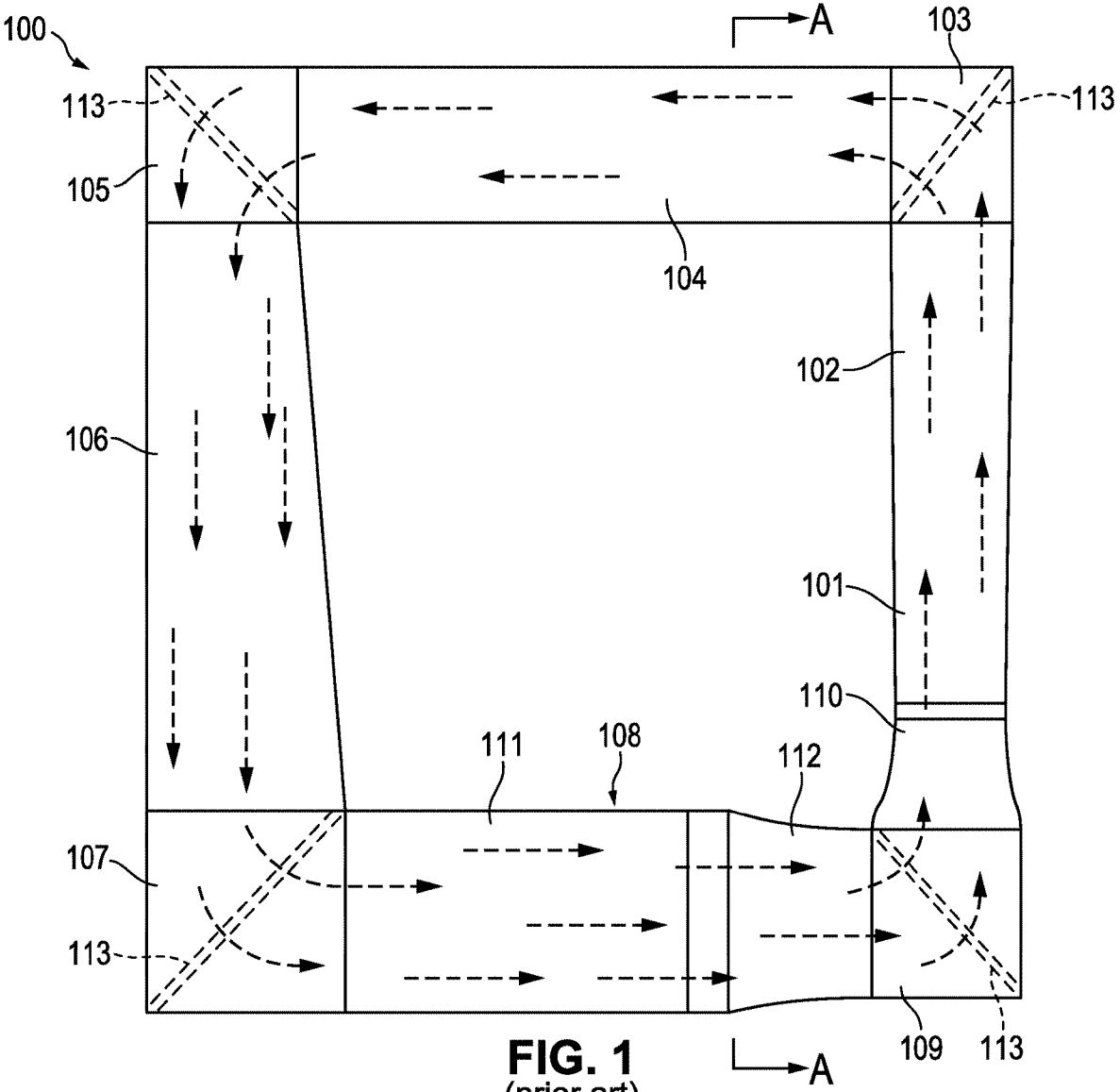
FIG. 1 (prior art)
FIG. 1 shows a side view of a recirculating vertical wind tunnel according to the prior art.
Figure 2:
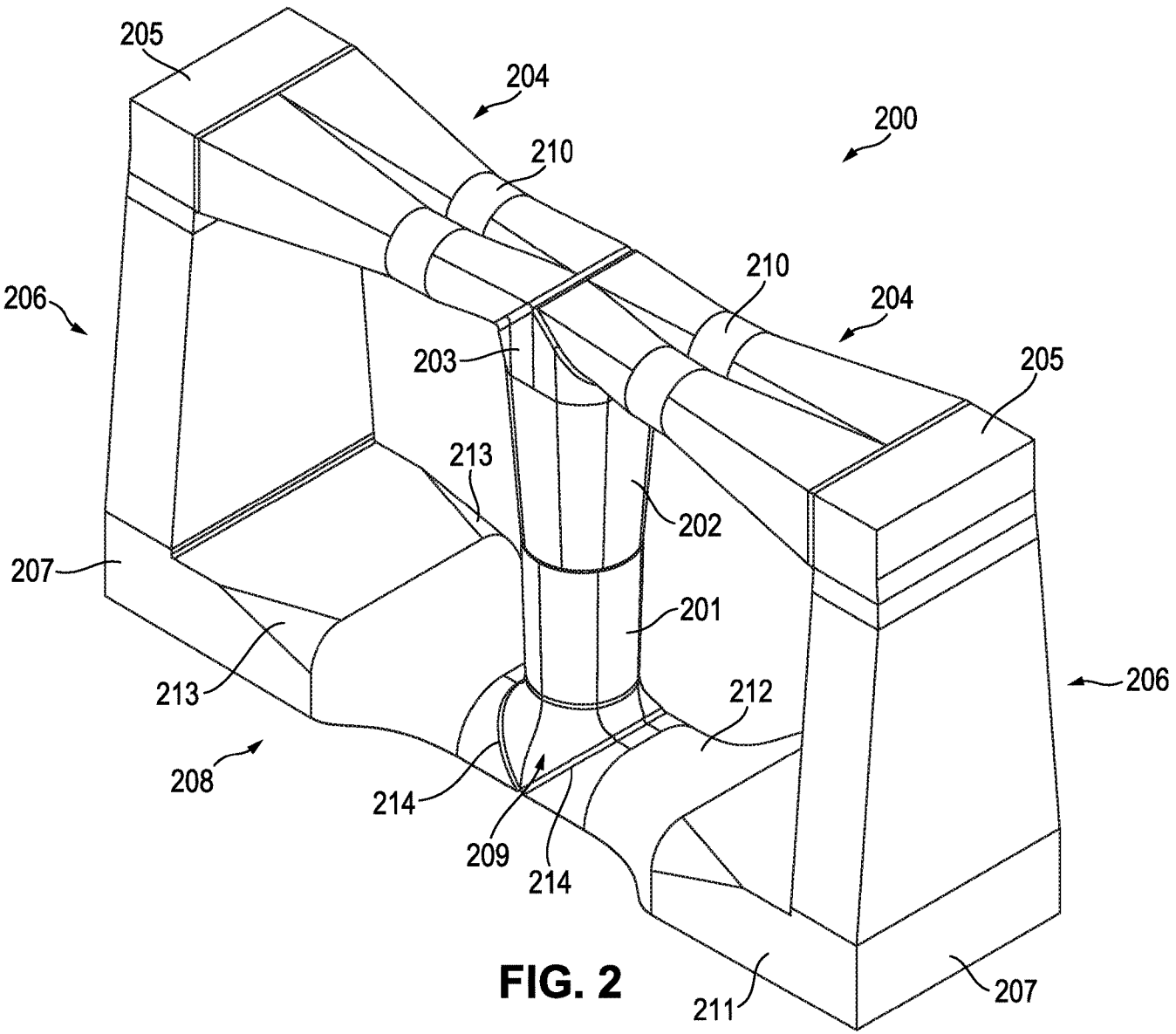
FIG. 2 shows a perspective view of a recirculating vertical wind tunnel according to the present disclosure.

FIGS. 1 and 1A show a recirculating vertical wind tunnel 100 according to the prior art. Moving in the direction of airflow, this wind tunnel 100 comprises a flight chamber 101, a diffuser 102 above the flight chamber 101, a first corner 103, an upper horizontal plenum 104, a second corner 105, a vertical return plenum 106, a third corner 107, a lower horizontal plenum 108, a fourth corner 109, and an inlet contractor 110 below the flight chamber 101. The lower horizontal plenum 108 has a first section 111 and a second section 112 with a contracting cross section. One or more fans (not shown) are arranged in the flowpath plenums to generate an airflow therethrough. The direction of the airflow is represented by broken arrows in FIG. 1. Turning vanes 113 are arranged in the corners 103, 105, 107, 109 to redirect the airflow between the diffuser 102 and the upper horizontal plenum 104, the upper horizontal plenum 104 and the vertical return plenum 106, the vertical return plenum 106 and the lower horizontal plenum 108, and the lower horizontal plenum 108 and the inlet contractor 110, respectively. The locations of the turning vane structures 113 are represented by broken lines in FIG. 1. The velocity of the airflow is increased through the decreasing cross sections of the second section 112 of the lower horizontal plenum 108 and the inlet contractor 110, before entering the flight chamber 101 to support users in indoor skydiving. Vertical wind tunnels may be provided with a single flowpath loop or a plurality of flowpath loops. In tunnels with two or more return loops, the different airflow pathways generally diverge at or near the first corner 103 above the flight chamber 101 and converge at or near the fourth corner 109 below the flight chamber 101. Multipath wind tunnels are generally symmetrical in design. Although typically more expensive to construct than flight chambers with rectangular cross sections, flight chambers with circular or substantially circular cross sections typically have a more uniform and lower turbulence airflow since the hard corners of rectangular cross sections produce turbulence. In the same way, the four corners of the inlet contractor 110 also introduces turbulence into the airflow entering the flight chamber 101.

Figure 28:
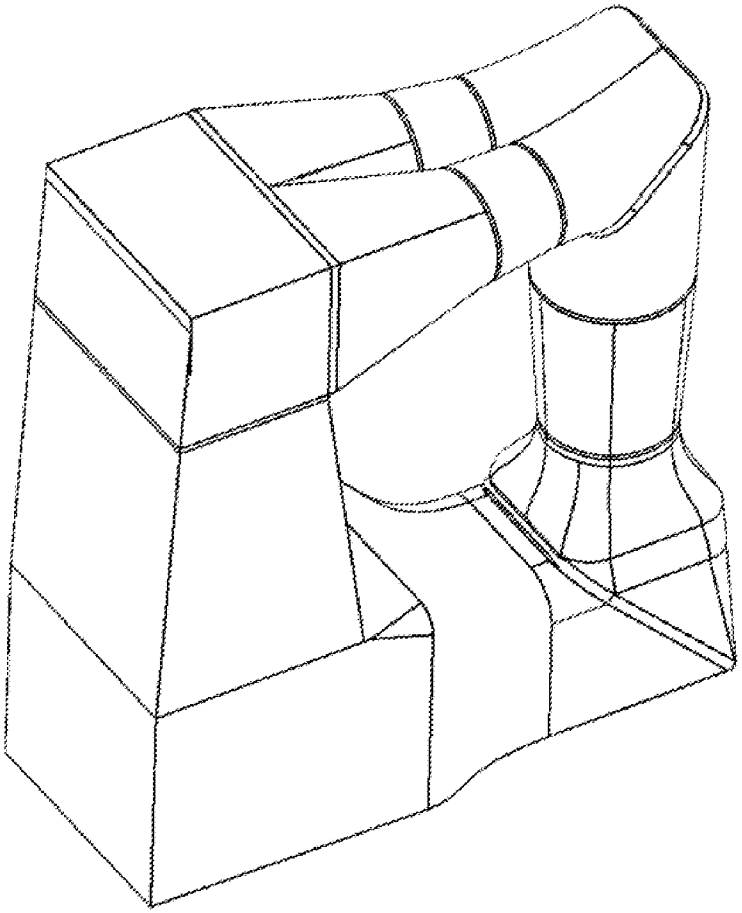
FIG. 28 shows another perspective view of the tunnel of FIG. 27.
Figure 27:
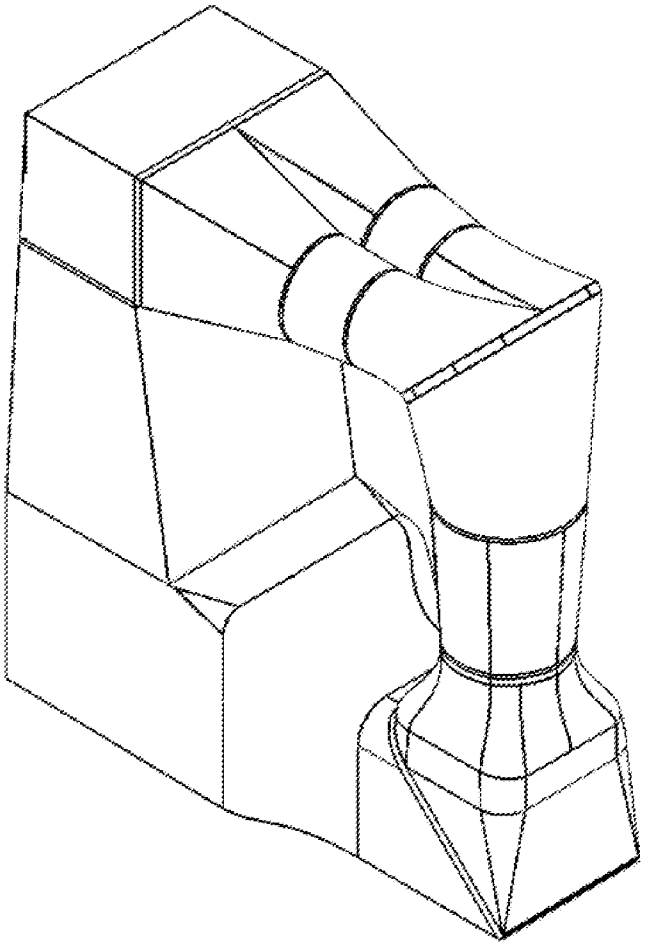
FIG. 27 shows a perspective view of a single-return recirculating wind tunnel having a contracting corner.

FIGS. 2 through 8 show one possible embodiment of a recirculating vertical wind tunnel 200 according to the present disclosure. Moving in the direction of airflow, the wind tunnel 200 comprises a flight chamber 201, a diffuser 202 above the flight chamber 201, a first corner 203, an upper horizontal plenum 204, a second corner 205, a vertical return plenum 206, a third corner 207, a lower horizontal plenum 208, and a fourth or contracting corner 209. The wind tunnel 200 has two symmetrical airflow return pathways which diverge at the first corner 203 and converge at the fourth corner 209. The following description generally refers to only a single side or loop of the wind tunnel 200 for purposes of convenience and conciseness; it being understood that both sides of the wind tunnel 200 are structurally identical unless specifically noted. In other embodiments, the wind tunnel 200 may comprise a single return flowpath (see FIGS. 27 and 28) or more than two return flowpaths (not shown). The single-return recirculating vertical wind tunnel of FIGS. 27 and 28 is designed the same in principle as the wind tunnel 200 of FIGS. 2-8 and is therefore not described in further detail here. The upper horizontal plenum 204 has two ducted fans 210 which generate the airflow through the wind tunnel 200. Other embodiments may have one fan 210 or more than two fans 210. Further, the fans 210 could also be located in other locations along the flowpath loop, including at locations that are not in the upper horizontal plenum 208. Additionally, multiple fans 210 may be provided in a single plenum rather than separate plenums as shown. The scope and spirit of the present disclosure is not so limited. According to simulations, the dual-return wind tunnel 200 has been shown to achieve comparable airflow quality (for purposes of indoor skydiving) in the flight chamber 201 to prior tunnel designs, for example with respect to turbulence, shear and velocity map uniformity.

The third corner 207 may have a relatively wide rectangular construction to reduce excavation depth. For example, if the cross section of the third corner 207 at the juncture with the lower horizontal plenum 208 was squarer, then the required height of the third corner 207 along the vertical dimension would need to be increased to maintain the same cross-sectional area through the third corner for purposes of reducing airflow friction. By horizontally widening out the third corner 207, the lateral footprint requirements for the foundation increase while the depth requirements are reduced, which results in net savings with respect to excavation costs if the flight chamber is placed at or near ground level. The vertical return plenum 206 may share the widened geometry of the third corner 207 at the juncture of the vertical return plenum 206 and the third corner 207. Likewise, the lower horizontal plenum 208 may also share the widened geometry of the third corner 207 at the juncture of the lower horizontal plenum 208 and the third corner 207.

The lower horizontal plenum 208 may comprise a first section 211 and a second section 212. In the direction of airflow, the vertical return plenum 206 transitions through the third corner 207 into the first section 211 of the lower horizontal plenum 208. The first section 211 then transitions into the second section 212 of the lower horizontal plenum 208. The second section 212 is connected to the fourth or contracting corner 209 below the flight chamber 201. Where the vertical return plenum 206 and/or the third corner 207 have rectangular cross sections, the first section 211 of the lower horizontal plenum 208 may have a generally rectangular cross section as well. Of course, these plenums 206, 207, 208 may have different geometries other than rectangular, including other polygonal geometries or curved geometries (e.g., circular, elliptical, or substantially so), including different combinations thereof. Flat walls forming rectangular geometries are generally used at these locations of the flowpath to reduce construction costs and complexity—which typically increase when using curved or many-sided geometries—even though the hard corners may introduce additional turbulence into the airflow.

The first section 211 of the lower horizontal plenum 208 may comprise corner transition portions 213 for the transition into the second section 212 of the lower horizontal plenum 208. For example, in the depicted embodiment, the cross section of the flowpath at the juncture between the first section 211 and the second section 212 is generally rectangular with rounded top corners. The upper corners of the first section 211 progressively transition between hard corners near the third corner 208 into such rounded corners at the second section 212 via the corner transition portions 213. In some embodiments, the corner transition portions 213 may extend along at least a majority of the longitudinal length of the first section 211. In other embodiments, the corner transition portions 213 may extend along at least two-thirds of the longitudinal length of the first section 211. Further yet, the corner portions 213 could extend along at least three-fourths of the length of the first section 211, including along the entire or substantially the entire longitudinal length of the first section 211. The corner transition portions 213 help to reduce turbulence downstream in the upper corners of the second section 212.

Figure 7:
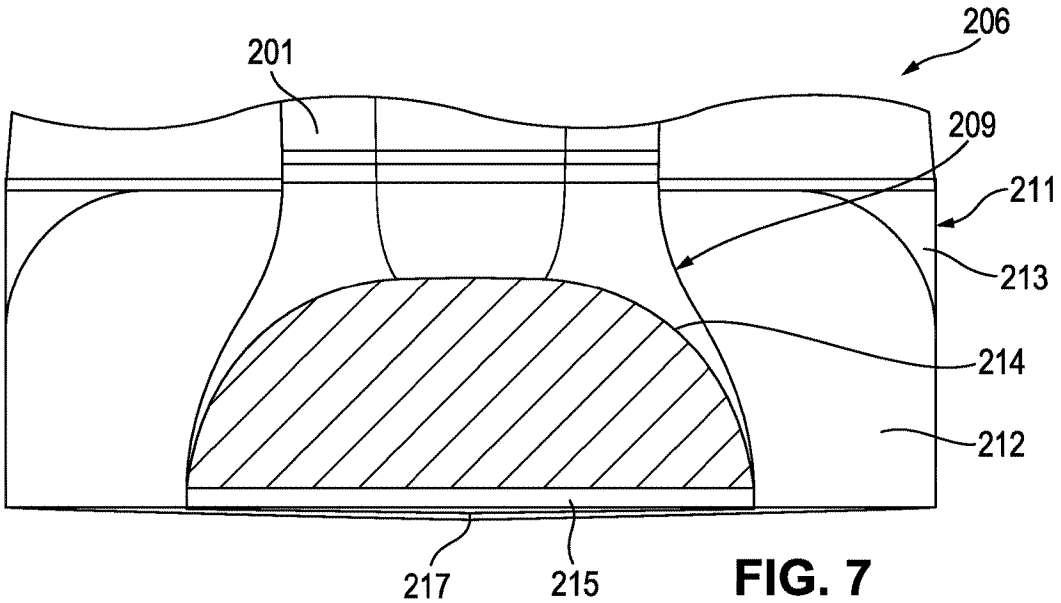
FIG. 7 shows a partial sectional side view of the fourth corner of the wind tunnel of FIG. 2, taken along line 7-7 of FIG. 6.

The second section 212 of the lower horizontal plenum 208 contracts from a generally rectangular cross section with rounded corners at the juncture with the first section 211, to a generally semi-oval or semi-elliptical cross section at the juncture with the fourth corner 209 when viewed along the longitudinal axis (see FIG. 7). Other terms of description for the shape of this cross section may include semi-stadium, tunnel, rainbow or the like, which refers to a flat or substantially flat bottom/base side bounded by an arch. The flowpath cross section of the second section 212 contracts in both the vertical and horizontal dimensions between the first section 211 and the fourth corner 209. This geometric contraction increases the velocity of the airflow entering the fourth corner 209. The smooth transition of the cross-sectional geometry in contracting along the longitudinal length of the second section 212 (between the first section 211 and the fourth corner 209) also promotes a low turbulence airflow during the acceleration of the airflow therethrough. Moreover, this contraction of the second section 212 positions the flowpath cross section for a smooth transition into and through the fourth corner 209. The generally semi-oval or semi-elliptical cross-sectional geometry of the second section 212 at the fourth corner 209, once turned through the fourth corner 209 into the horizontal plane, facilitates the formation of a generally round horizontal cross section for the ascending airflow at the outlet of the fourth corner 209 beneath the flight chamber 201, which allows for a shorter low turbulence contraction.

The contracting corner 209 turns the airflow in the lower horizontal plenum 208 upward directly into the flight chamber 201. At the same time, the contracting corner 209 also reduces the total cross-sectional area of the flowpath between the lower horizontal plenums 208 and the base of the flight chamber 201, which increases the velocity of the airflow for suspension of users within the flight chamber 201. In embodiments with two or more return loops, the contracting corner 209 also merges the separate airflows before the same enters the flight chamber 201. By integrating the fourth corner and inlet contractor together in a single structure, the need for a separate inlet contractor structure beneath the flight chamber is eliminated. In this way, the vertical distance between the base of the flight chamber 201 and the base of the contracting corner 209 and/or lower horizontal plenum 208 can be significantly reduced.

For example, the height of the tunnel flowpath between the base of the fourth or contracting corner 209 and the base of the flight chamber 201 can be reduced by approximately 35% relative to comparable wind tunnel designs, without significant sacrifice to efficiency. This may correspond to a height of approximately 10 feet or more. The height savings also corresponds to shortening of the overall tunnel flowpath. With the disclosed design, both reduced-excavation constructions and even entirely above-grade constructions are viable. Benefits include construction cost savings, construction time savings and construction risk reduction. Further, decreased height requirements make it viable to build in locations with height restrictions.

Specifically, in certain embodiments, for a dual-loop recirculating wind tunnel, a height between the base of the flight chamber 201 and the base of the contracting corner 209 (or lower horizontal plenum 208) can be realized which is less than or equal to 1.3 times the diameter of the flight chamber 201. In other words: [the vertical distance between the base of the flight chamber and the base of the contracting corner] is ≤[1.3×the diameter of the flight chamber]. For a single-loop recirculating wind tunnel, in certain embodiments, a height between the base of the flight chamber 201 and the base of the contracting corner 209 (or lower horizontal plenum 208) can be realized which is less than or equal to the diameter of the flight chamber 201 multiplied by a factor of 1.9. In other words: [the vertical distance between the base of the flight chamber and the base of the contracting corner] is ≤[1.9×the diameter of the flight chamber].

Regarding costs and therefore potential savings, it should be appreciated that the cost to build a wind tunnel is dependent on location. Factors include the cost of tunnel materials, the cost of labor, the cost of transporting materials to location, the cost of earthworks for a particular location, etc. Factors can also vary with quality and availability. Timing, both in terms of project timeframes and market forces, can further affect cost. In other words, each project has its own challenges and circumstances that make direct comparisons across completed tunnel locations difficult. Based on available data and project estimates, a wind tunnel according to the present disclosure can save about $20,000 to $100,000 USD per foot excavation, with an estimated average of about $40,000 USD. This correlates to as much as $400,000 USD or more per construction. Some projects could realize savings upwards of 1,000,000 USD or more. These savings can compensate for increased costs in other respects, if any, such as custom fabrication, transportation, or using relatively more expensive materials. Putting aside excavation depth considerations, it would seem counterintuitive that the complex geometries and curvature of a contracting corner according to the present disclosure could result in cost savings over more basic geometries (e.g., rectangular corners made of poured concrete). But once molds are created for curved wall plenums (e.g. lower horizontal plenum section 212), which are reusable for future projects of the same model, it can actually save on costs compared to pouring concrete. For example, using pre-formed fiberglass plenums with complex curvature can produce savings up to $100,000 USD with respect to part and installation costs, compared to poured concrete for simple plenum geometries (e.g. flat walls), which offsets potential increases in shipping and material costs. With the height reduction, concrete (Construction Specifications Institute (CSI) 2012 Division Code 03) and earthwork (CSI 2012 Division Code 31) costs can be significantly decreased in the magnitude of several hundred thousand dollars. Earthworks in particular can realize significant savings depending on the tunnel location, since location moisture, soil type, bedrock depth, etc. alone can significantly increase excavation and required shoring costs, in some cases to over $1,000,000 USD total for especially challenging build sites. Further, average project timeframes are estimated to be reduced initially by one to two months according to the present disclosure. Such time savings cannot be understated in relation to keeping project costs down and accelerating returns from opening the wind tunnel facility. Again, it must be appreciated that every construction project is unique and depends on the interplay of a plurality of factors; meaning potential savings discussed herein may not be realized in each instance. However, the limited data and current estimates reveals that significant savings are anticipated in constructing a wind tunnel having a contracting corner design according to the present disclosure, and generally regardless of the specific project location.

The contracting corner 209 comprises smooth or substantially-smooth curvature throughout the plenum wall transitions. This construction also reduces turbulence through the corner 209. In a dual-return or double-looped wind tunnel design (see FIGS. 2-8), the contracting corner 209 may be described as comprising two curved arches 214. The bottom surfaces of each of the lower horizontal plenums 208 join to form a centerline 215 at one end of the contracting corner 209 along the transverse axis of the wind tunnel 200. This centerline 215, then, may be said to form the base of the contracting corner 209. The arches 214 of the contracting corner 209 each span upward from the ends of the centerline 215, at an incline away from one another, to define the cross-sectional geometry of the flowpath in the transition of the plenum walls between the second section 212 of each lower horizontal plenum 209 to the flight chamber 201. In this way, the arches 214 form a V-shape bisected by the transverse axis of the tunnel 200, with the centerline 215 formed at the nadir or base midpoint of the V-shape (see FIG. 8). Each arch 214 is located where the duct construction of the contracting corner 209 joins the duct construction of the lower horizontal plenum 208. However, it should be appreciated that the arches 214 themselves need not be formed by independent structures along the plenum wall transitions. For example, at least part of the lower horizontal plenum(s) 208 and the contracting corner 209 could also be formed in a single-piece. The arches 214 are descriptive of points in space along the plenum transition and not necessarily formed by, or provided as separate structures at, a physical juncture between plenum segments. Likewise, any delineation between "corners" and "plenums" herein is for convenience of description, as it is possible to join flowpath structures of the wind tunnel 200 at different locations.

Further, the centerline 215 constitutes a ridge in the depicted embodiment. Here, the ridge 215 is formed by the bottom surfaces of each of the lower horizontal plenums 208 turning upward to meet at the centerline 215. In other embodiments, the ridge 215 may be formed by one or more components installed at this position (e.g. if the bottom surfaces of the lower horizontal plenums 208 are flat or substantially flat and do not themselves turn upward to form a ridge). The ridge 215 helps to redirect the airflow along the bottom surface of each lower horizontal plenum 208 upward into the contracting corner 209 and reduce turbulence from merging the airflows, at least compared to embodiments not having an upward-projecting ridge structure wherein the airflows along the bottom surfaces would meet head on. However, it should be appreciated that the ridge is not strictly required to realize benefits of the present disclosure and indeed may be absent in other embodiments. In that case, the centerline 215 (the nadir or base midpoint of the V-shape described above) may be provided as a flat or substantially flat surface. For example, the bottom surfaces of the plenums 208 may join in a flat or substantially flat manner at the centerline location or the centerline 215 may be located along the surface of a single plenum component at this location, depending on the particular construction. In single-return embodiments, the centerline 215 may be provided where the bottom surface of the lower horizontal plenum 208 joins with a vertical or substantially vertical end wall of the contracting corner 209, for example at a hard edge or through a curved surface transition. Therefore, like the arches 214, the centerline 215 is descriptive of points in space.

Nonetheless, using these conventions, the contracting corner 209 smoothly transitions from the circular base of the flight chamber 201 to points along one of the arches 214. Along the longitudinal axis of the lower horizontal plenums 208, the smooth transition of the plenum walls of the contracting corner 209 comprises a single or substantially single curvature in moving between the base of the flight chamber 201 and the apex of each respective arch 214 (see FIG. 8); other embodiments could comprise a slight S-shaped double curvature profile here. Along the transverse axis, which is perpendicular to the longitudinal axis in the horizontal plane, the smooth transition of the walls of the contracting corner 209 comprises an S-shaped double curvature profile in moving between the base of the flight chamber 201 and ends of each respective arch 214 at the centerline or ridge 215 (see FIG. 7). The walls of the contracting corner 209 do not comprise any hard-angle corners; all surfaces are smooth with the transitions effectuated through curves. This promotes aerodynamic efficiency while minimizing turbulence. The cross section of the second section 212 of the lower horizontal plenum 208 may be semi-elliptical in approaching the contracting corner 209, such that each inclined arch 214 defines the top and side walls of the lower horizontal plenum 208 at its juncture with the contracting corner 209. The base of the lower horizontal plenum 208 may be flat, substantially flat, or curved as described below.

Figure 4:
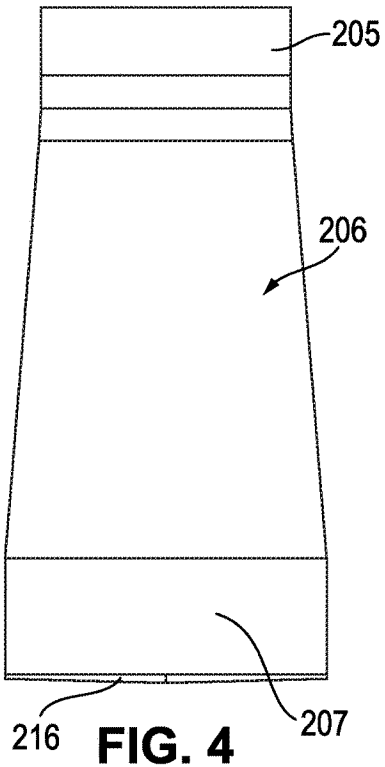
FIG. 4 shows a right side view of the wind tunnel of FIG. 2.
Figure 3:
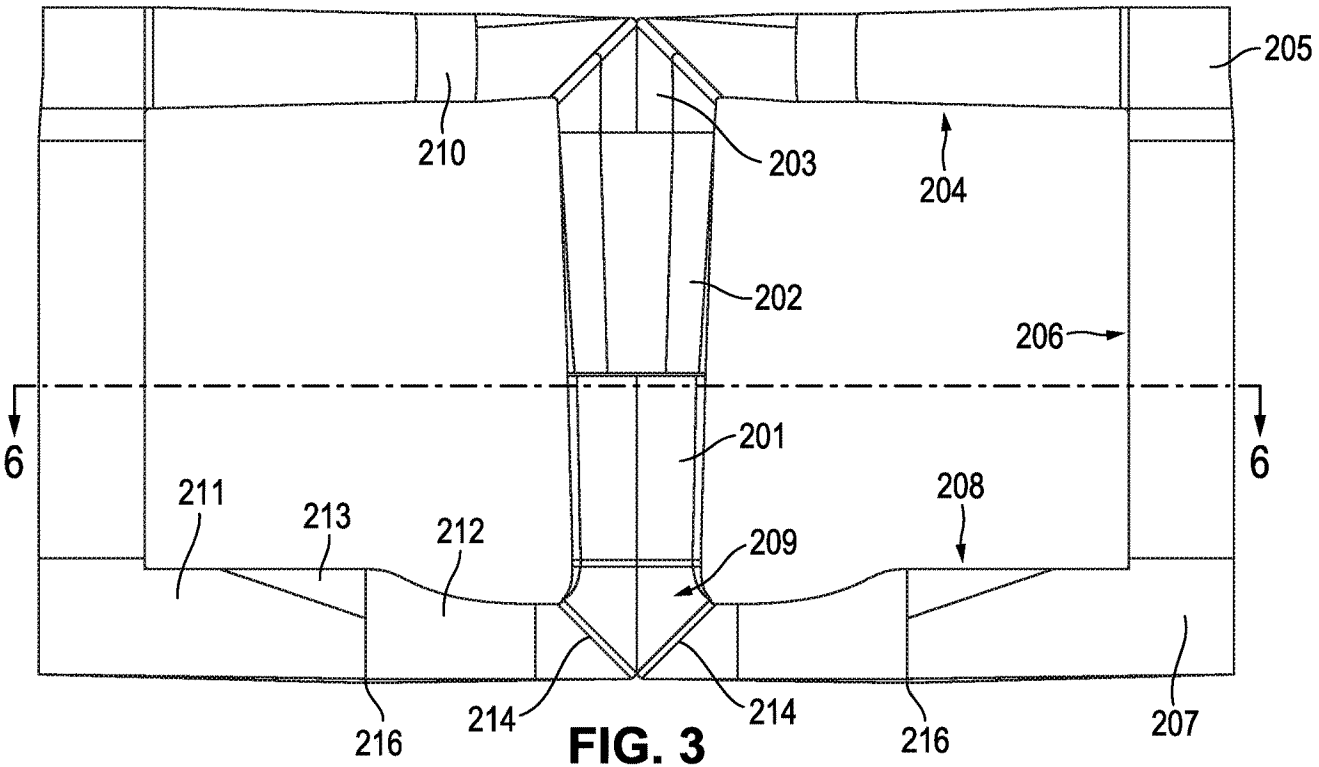
FIG. 3 shows a front side view of the wind tunnel of FIG. 2.
Figure 5:
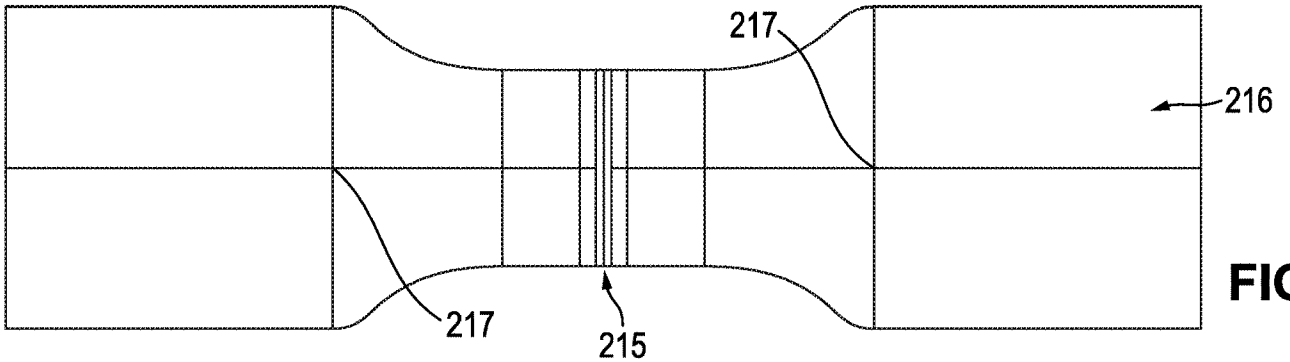
FIG. 5 shows a bottom view of the wind tunnel of FIG. 2.
Figure 6:
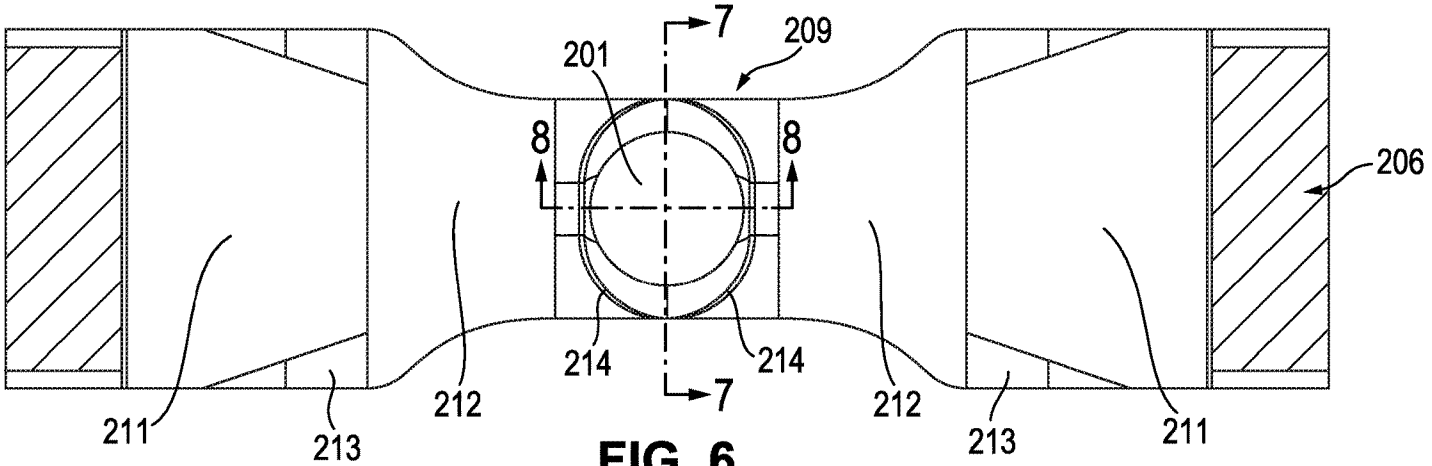
FIG. 6 shows a top sectional view of the wind tunnel of FIG. 2, taken along line 6-6 of FIG. 3.
Figure 8:
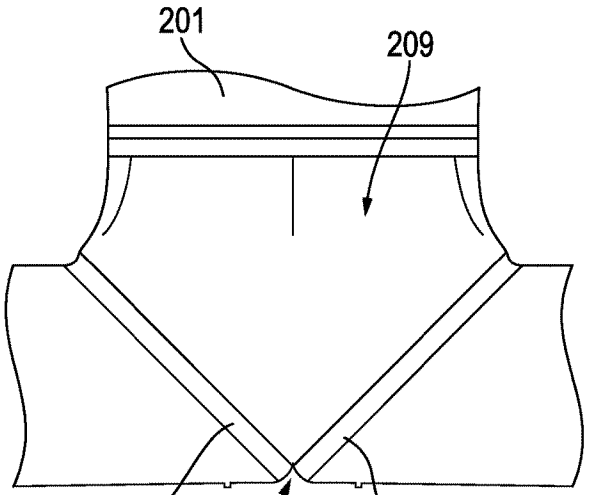
FIG. 8 shows a partial sectional side view of the fourth corner of the wind tunnel of FIG. 2, taken along line 8-8 of FIG. 6.

The bottom surface or floor 216 of the lower horizontal plenum 208, or the lower horizontal plenum 208 and the third corner 207 and/or fourth corner 209, may be configured for draining any liquids that might accumulate in the wind tunnel 200. As shown in FIGS. 3 through 5, for example, the entire or substantially the entire bottom surface 216 on each side of the fourth corner 209 may be bowl-shaped. The lowest point 217 of each bowl-shaped surface 216 may be provided with a drain. In some embodiments, the lowest point 217 of the floor 216 may be located at the juncture between the first section 211 and the second section along the center longitudinal axis through the lower horizontal plenum 208 (see FIG. 5). In this way, the "fall" of the floor 216 along the longitudinal axis in and after the third corner 207 may help accommodate the directional change of the airflow through the third corner 207 into the lower horizontal plenum 208. The "rise" of the floor 216 along the longitudinal axis in moving through the second section 212 between the first section 211 and the contracting corner 209 may therefore coincide with the contraction of flowpath in the second section 212. Likewise, along the transverse axis, the bowl-shape of the bottom floor 216 may further reduce turbulence therethrough. The reduced vertical depth of the floor 216 along the perimeter of the bowl-shape can provide further excavation savings. To this end, the base of the third corner 207 may be positioned higher in the vertical direction than the base of the fourth corner 209 in some embodiments. A pump may be provided to assist in draining liquid accumulation.

Figure 10:
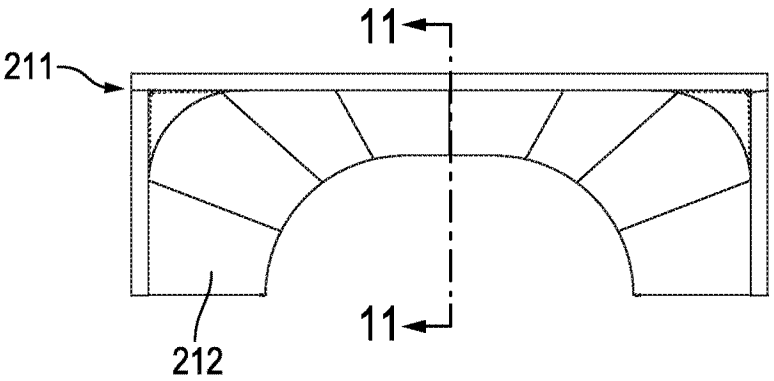
FIG. 10 shows a side view of the lower horizontal plenum of FIG. 9.
Figure 12:
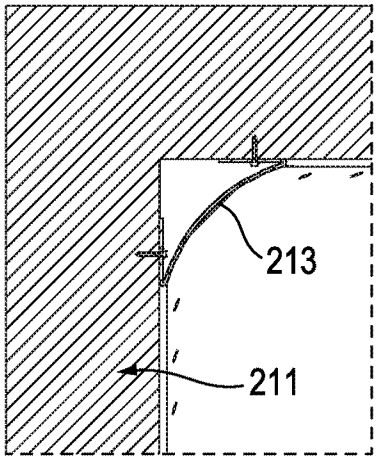
FIG. 12 shows a sectional view taken along line 12-12 of FIG. 11.
Figure 9:
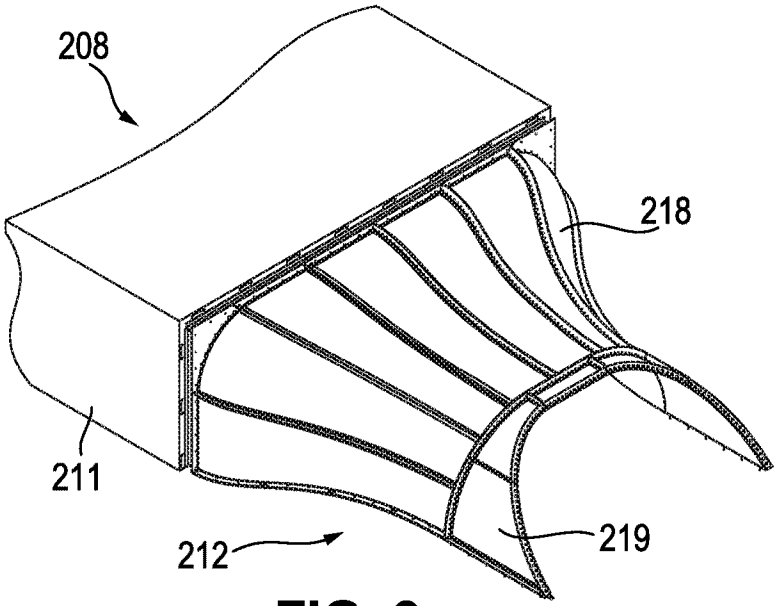
FIG. 9 shows a partial perspective view of a lower horizontal plenum of the wind tunnel.
Figure 11:
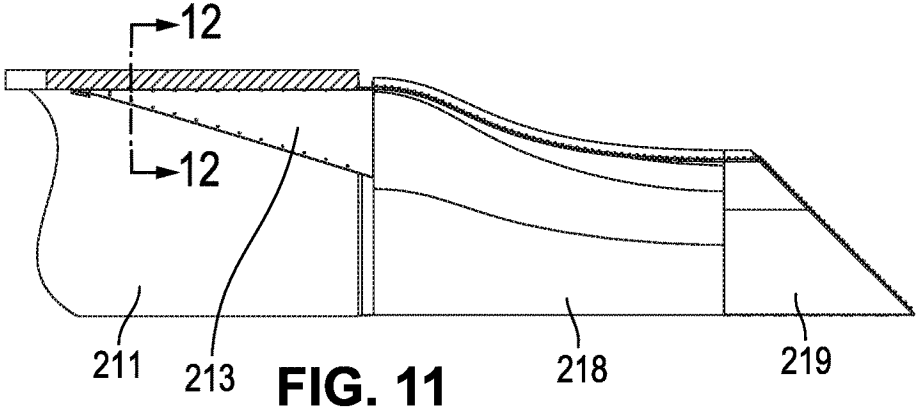
FIG. 11 shows a sectional view taken along line 11-11 of FIG. 10.

FIG. 9 shows another embodiment of the lower horizontal plenum 208 including a first section 211 (partial view) and a second section 212. In this embodiment, the second section 212 has a two-piece construction comprising a contracting portion 218 connected to the first section 211, and a constant cross-sectional area transition portion 219 which connects to the contracting corner 209. Furthermore, the floor 216 of the lower horizontal plenum 208 completing the closed flowpath of the airflow is provided separately from the plenum wall structures. For instance, the floor 216 may be concrete to reduce costs, while the wall structures could be fiberglass or other materials fabricated into specific shapes, which generally increases cost. This is another example of how the flowpath structures described herein could be alternatively constructed and assembled within the scope and spirit of the present disclosure. Likewise, the transition portion 219 could be characterized as either a part of the lower horizontal plenum 208 or a part of the contracting corner 209. As in the depicted embodiment, the first section 211 may not be shaped to form the corner transition portions 213. Rather, as seen in FIGS. 10 through 12, the corner transition portions 213 may be separate structures (e.g., plates) mounted inside the plenum of the first section 211. In this way, the first section 211 may be constructed with flat or substantially flat walls to reduce costs. The corner transition portions 213 define the cross section of the flowpath through the first section 211 at the corners. The corner transition portion 213 may be shaped to smoothly contract the cross section of the flowpath in moving between the hard corners near the third corner 207 to the rounded or generally rounded corners at the juncture with the second section 212.

Figure 13:
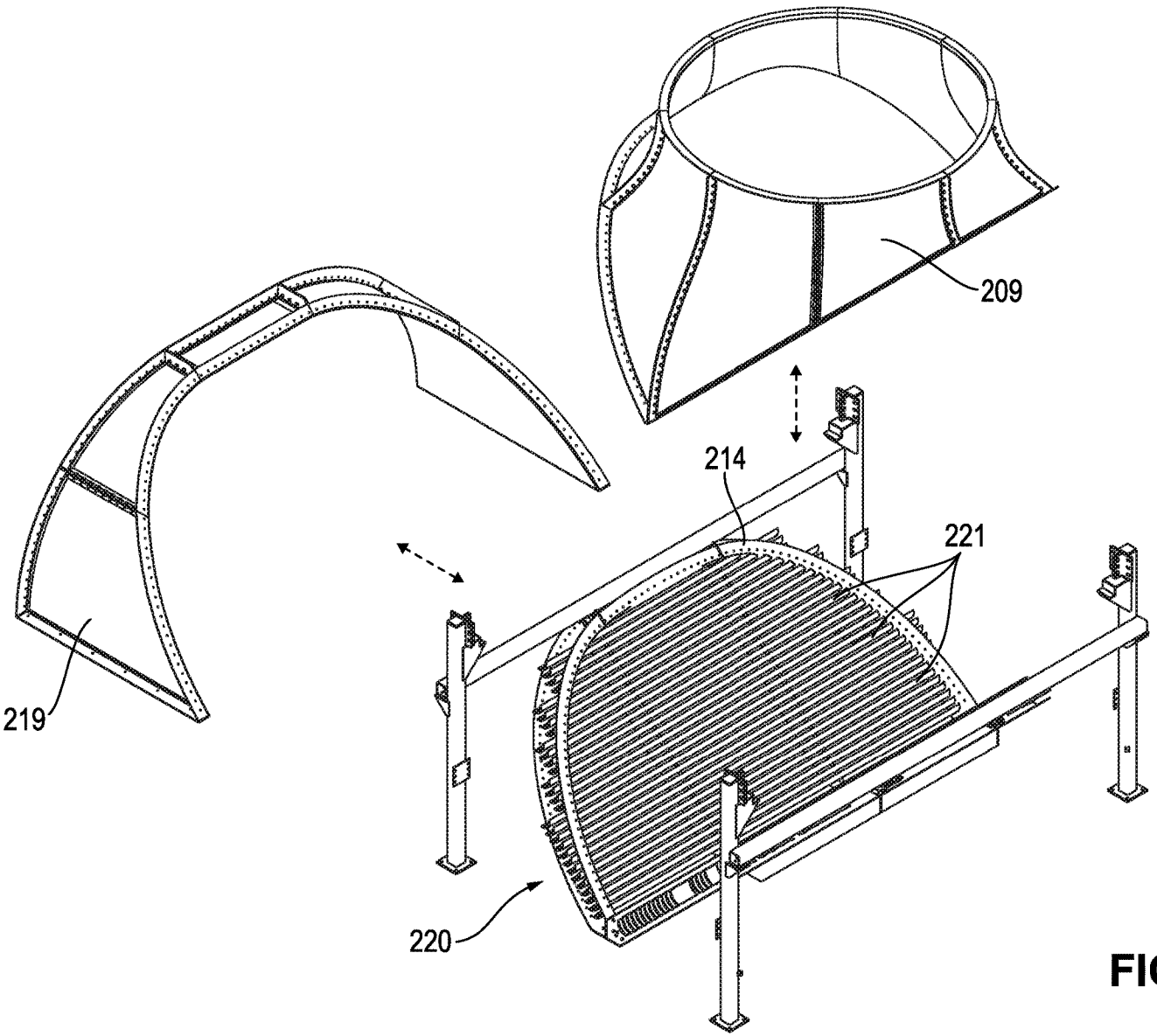
FIG. 13 shows an exploded perspective view of another embodiment comprising a turning vane structure.
Figure 14:
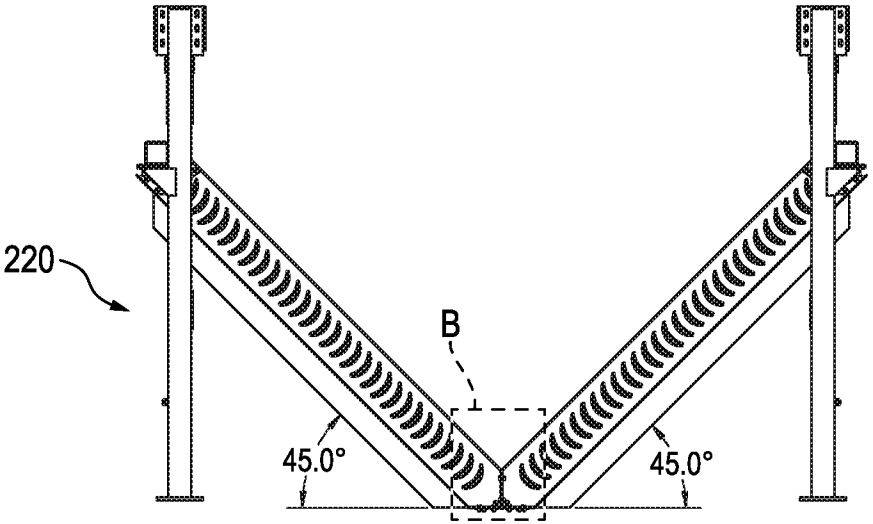
FIG. 14 shows a side view of the turning vane structure of FIG. 13.
Figure 15:
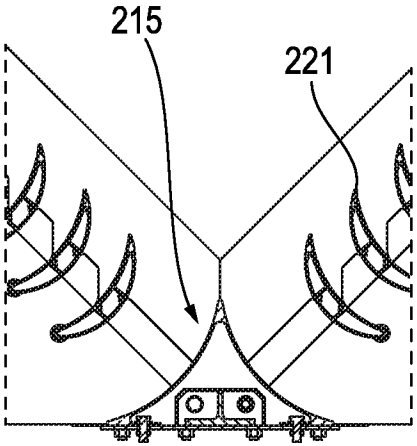
FIG. 15 shows a sectional view taken through the center of the base of the turning vane structure in the area of box B of FIG. 14.
Figure 16:
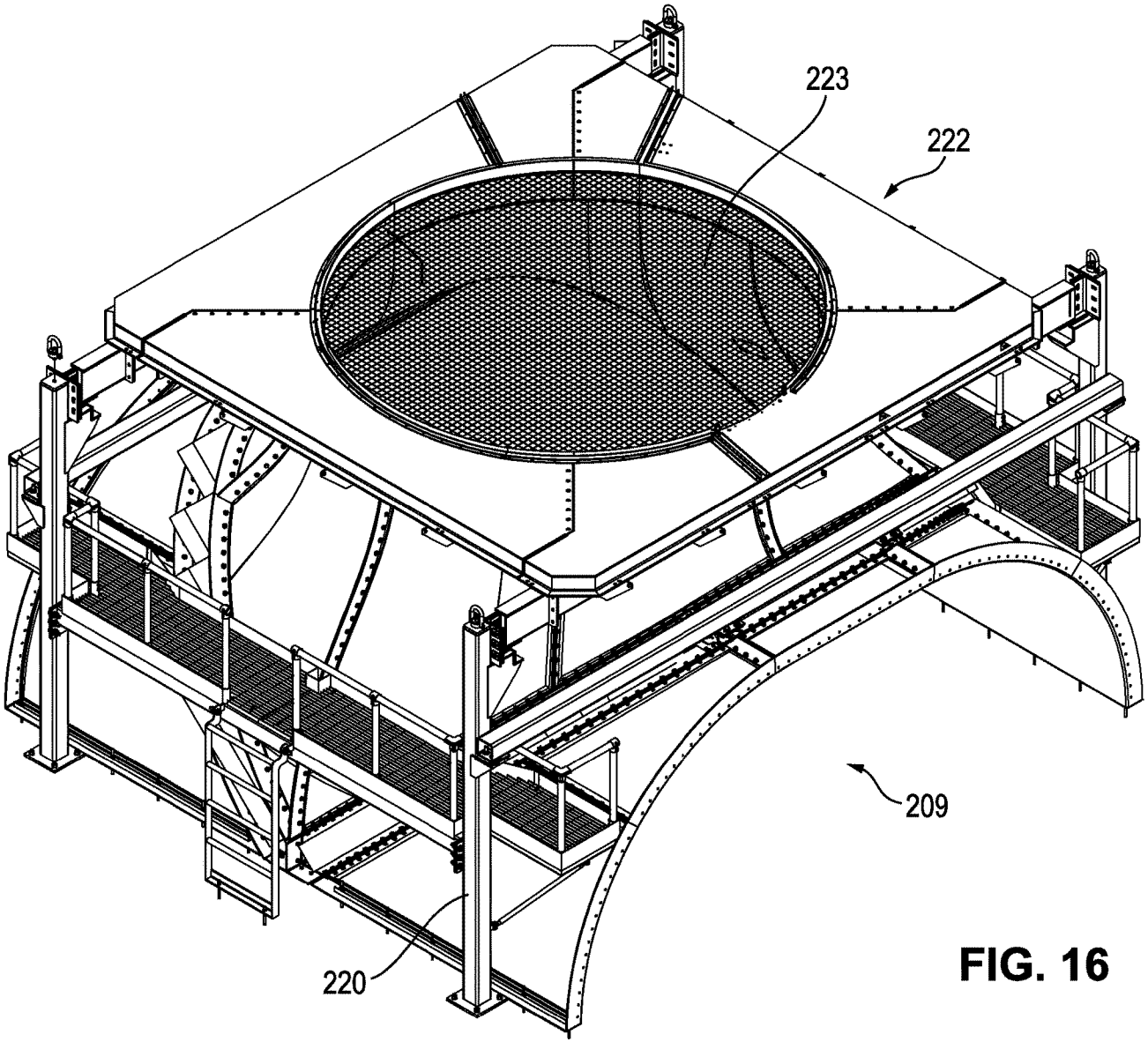
FIG. 16 shows a perspective view of another embodiment comprising a cable floor assembly.
Figure 17:
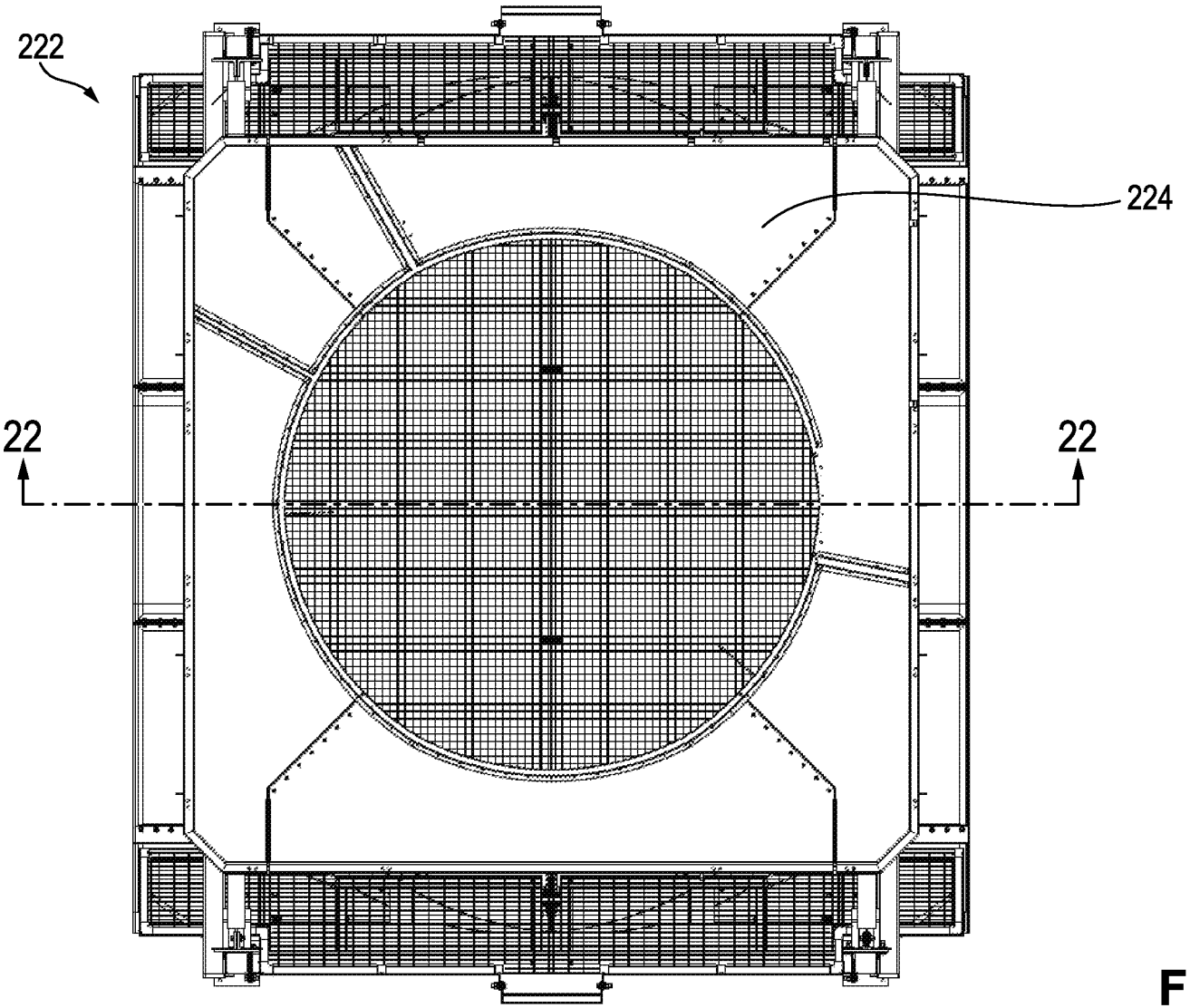
FIG. 17 shows a top view of FIG. 16.

FIGS. 13 and 14 show another embodiment where the arches 214 of the contracting corner 209 correspond to a frame structure 220 comprising a plurality of turning vanes 221. In the depicted embodiment, each side of the frame structure 220 is laterally connected to a transition portion 219 of the second section 212, although the lower horizontal plenum 208 could have other constructions as well. Above, the frame structure 220 is connected to the contracting corner 209. The turning vanes 221 are configured to redirect the airflow upward toward the flight chamber 201. The turning vanes 221, and therefore the arches 214, are arranged at an incline from the horizontal plane. As seen in the depicted embodiment of FIG. 14, the arches 214 may be inclined at approximately 45° for example. As seen in FIG. 15, the centerline 215—which corresponds to the ridge 215 in the depicted embodiment—may be provided by a separate structure (e.g. plates) from the adjacent plenum floor in some embodiments. As noted above, the ridge 215 may be omitted in some embodiments; although the ridge component improves flow uniformity through the center of the flight chamber by turning the airflow along the bottom surface of the plenum 208 upward in the manner of a turning vane, it is not strictly necessary to realize all the benefits of the present disclosure described herein. The turning vanes 221 may be hollow or comprise channels to flow a cooling fluid therethrough to counteract frictional heat generation from the recirculating airflow. The frame structure 220 may provide structural support to the contracting corner 209, and therefore parts of the tunnel 200 mounted above the contracting corner 209. Therefore, the frame structure 220 may be load-bearing and securely mounted in the floor adjacent to the tunnel plenum. Of course, other structures (e.g. building support beams) may also provide structural support to the tunnel components, in which case the frame structure 220 need not be load-bearing depending on the design.

Figure 19:
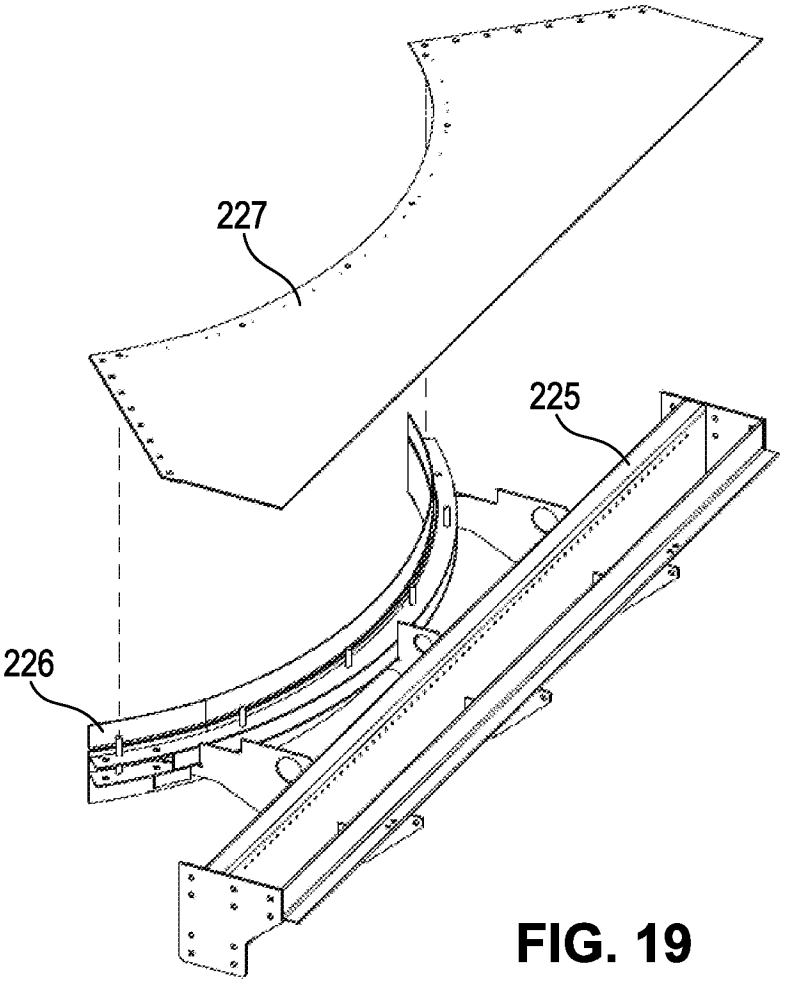
FIG. 19 shows an exploded view of FIG. 18.
Figure 18:
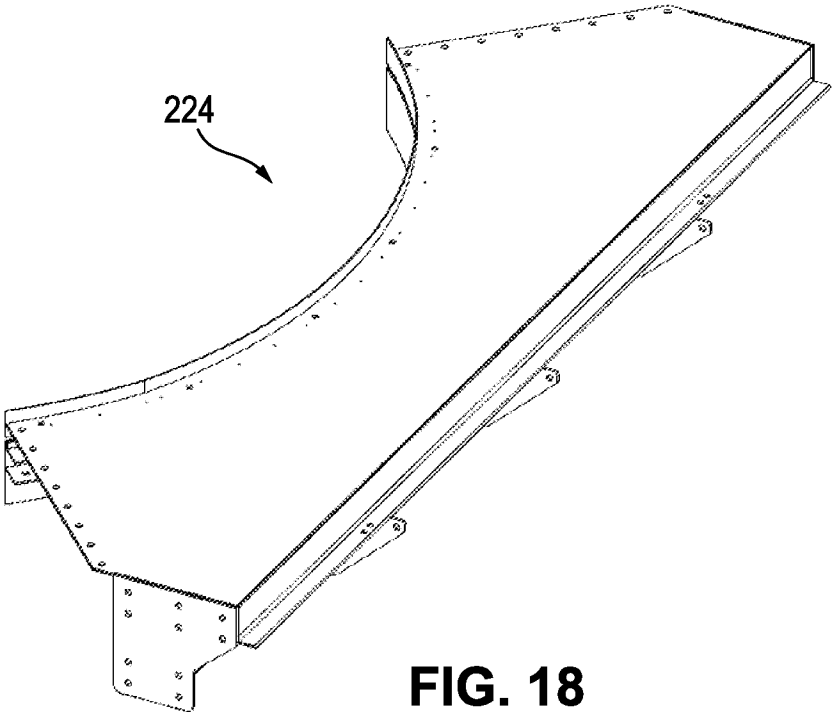
FIG. 18 shows a perspective view of one of the weldments of the cable floor assembly of FIG. 16.

Turning now to FIGS. 16 through 25, in a further embodiment, the wind tunnel 200 also comprises a cable floor assembly or structure 222. The cable floor assembly 222 may be mounted to a frame structure 220 as in the embodiment of FIGS. 13-15. In this way, the cable floor assembly 222 is integrally supported by the structure of the wind tunnel 200, which eliminates the need to provide separate load-bearing elements to support the cable floor assembly 222, thereby reducing construction costs of the wind tunnel facility. The cable floor assembly 222 comprises a plurality of cables 223 that form a floor in the flight chamber 201 which users can stand on and which the airflow may pass through to suspend users. The cable floor assembly 222 also comprises a plurality of casings or weldments 224 around the periphery of the flight chamber 201. Referring now to FIGS. 18 and 19, each of the weldments 224 may have a mounting plate 225 for securely mounting the ends of the cables 223 thereon; a fairing 226 which forms part of the airflow plenum wall at the juncture of the flight chamber 201 and the contracting corner 209 (see FIGS. 23 and 24); and a cover plate 227 which provides a floor surface adjacent to the flight chamber 201 on the observation level of the wind tunnel facility. The cover plate may be configured for mounting panels 228 which form the walls of the flight chamber 201.

Figure 21:
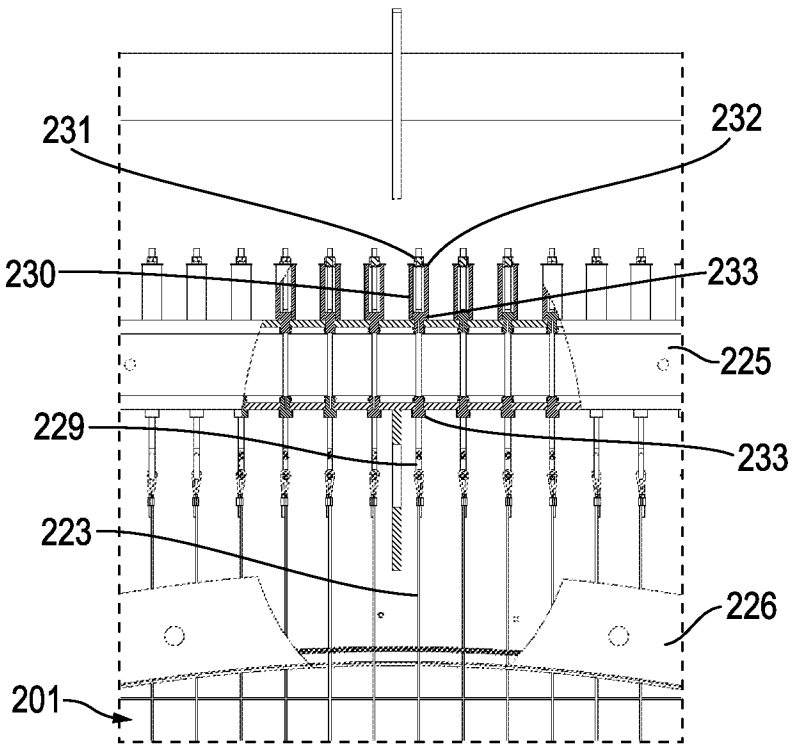
FIG. 21 shows a detail view of box C of FIG. 20 with partial cutaway.
Figure 20:
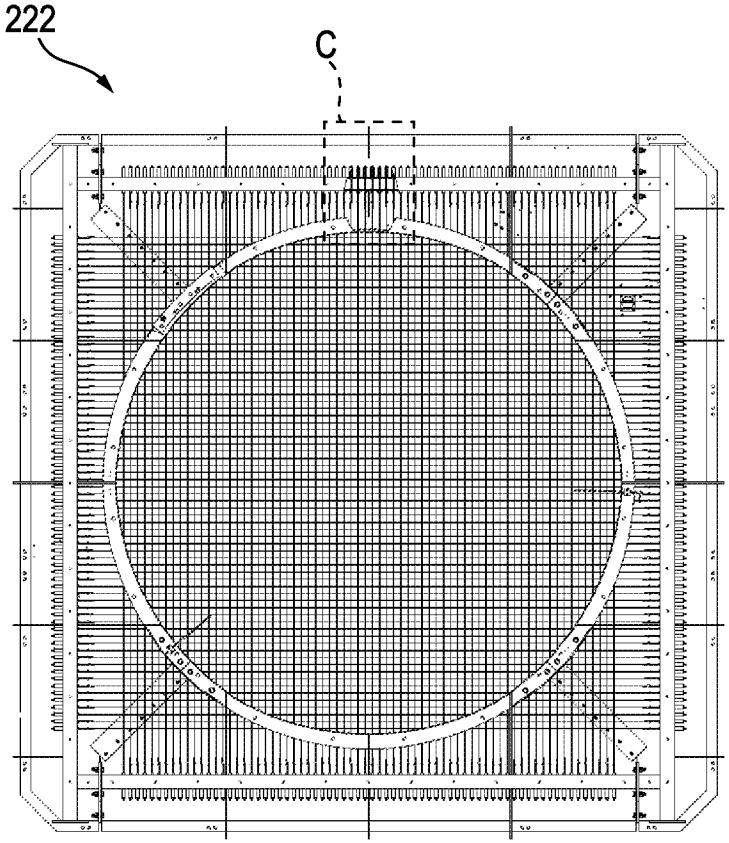
FIG. 20 shows a bottom view of the cable floor assembly of FIG. 16.
Figure 22:
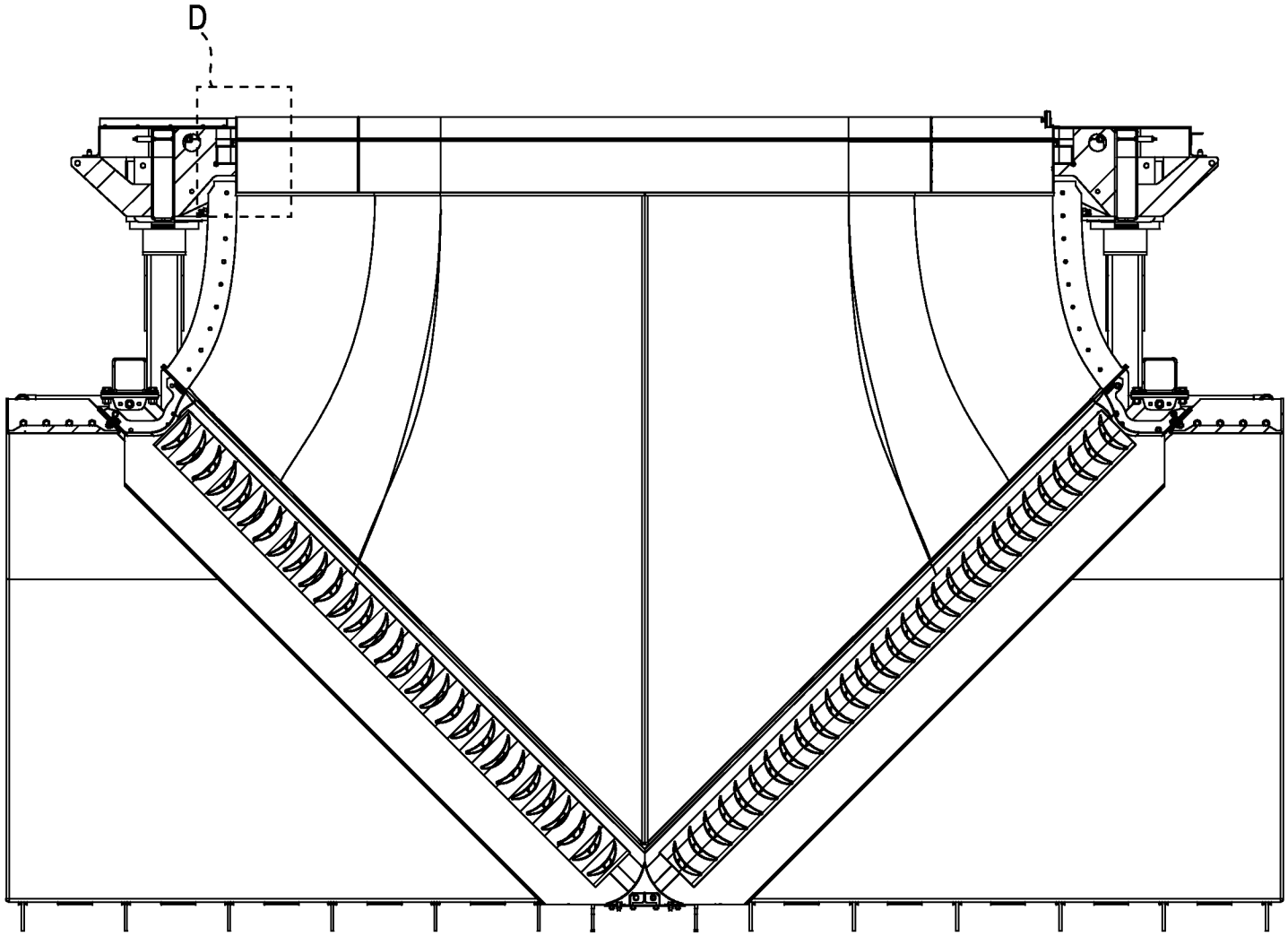
FIG. 22 shows a sectional view taken along line 22-22 of FIG. 17.

As seen in FIG. 21 (which includes an oval cutaway area to show additional portions of components), all of the cables 223 may be the same length and arranged in a square or substantially square profile pattern across the base of the flight chamber 201. In this way, cable production and replacement costs can be decreased since a single cable specification is utilized for the entire floor. This can also increase the pool of suitable suppliers for the cables 223. Each cable 223 is attached to an eye bolt 229. The eye bolt 229 extends through the mounting plate 225 of the respective weldment 224 to attach to a compression spring 230 via a nut 231 and washer 232 under tension (although other coupling components may also be used). Bushings 233 may reduce wear on and retain proper alignment of the eye bolt 229. Thus, each cable 223 is held taut across the flight chamber 201 and configured to flexibly absorb forces (e.g., from users falling to prevent injury) via the compression spring 230. With this mounting configuration, the cable 223 itself can be easily replaced if needed without having to also disassemble the other components from the mounting plate 225.

Figure 24:
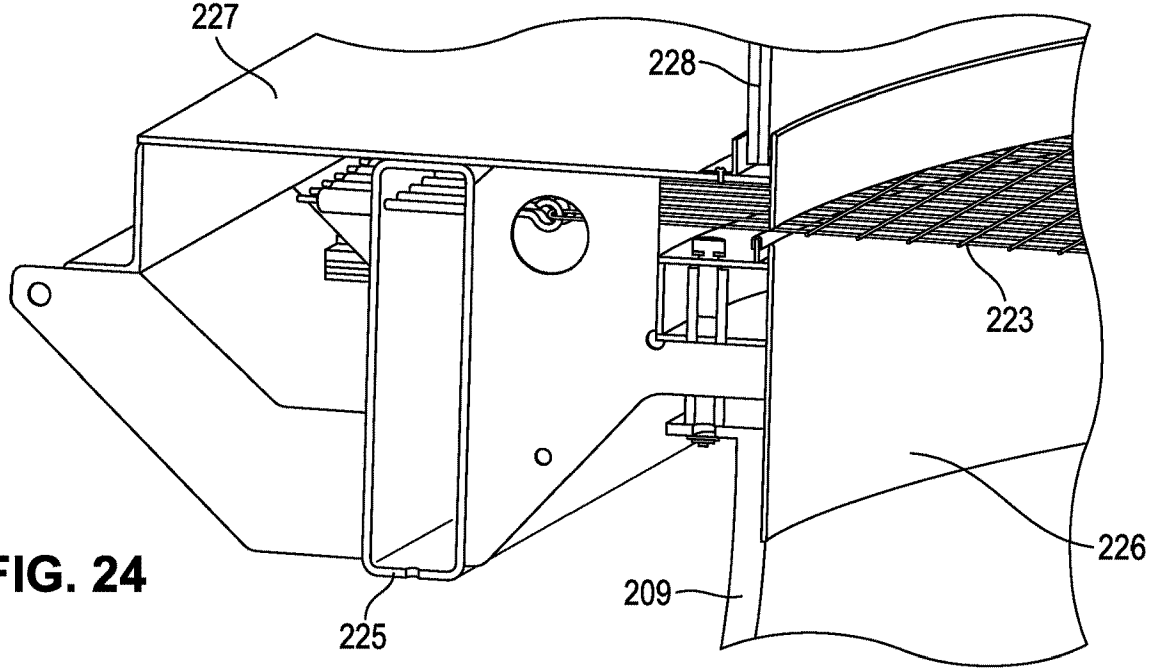
FIG. 24 shows a wider perspective view of FIG. 23.
Figure 23:
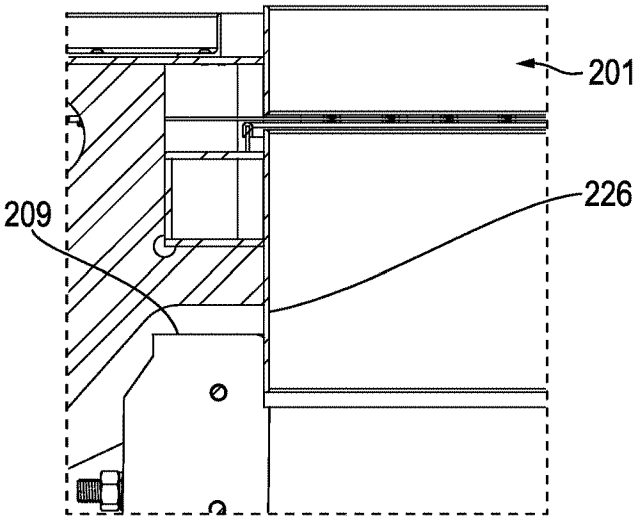
FIG. 23 shows a detail view of box D of FIG. 22.
Figure 26:
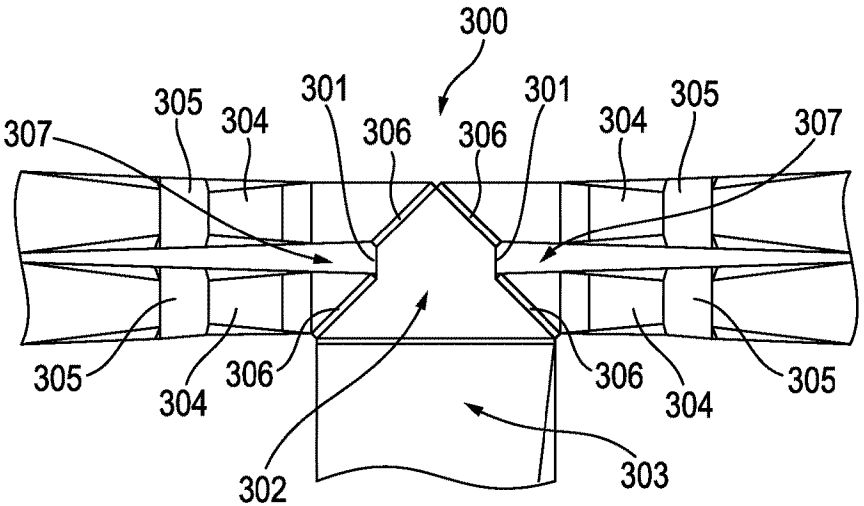
FIG. 26 shows a partial side view of the corner of a dual-return recirculating wind tunnel and a stepped corner configuration

As seen in FIGS. 23 and 24, the fairing 226 of the weldment 224 includes an aperture or slot to allow the cables 223 to exit the flight chamber 201 for attachment to the mounting plate 225. The fairing 226 overlaps the plenum wall of the contracting corner 209 at the base of the flight chamber 201 to form a continuous surface therebetween. Panels 228 are securely mounted to the cover plate 228 around the fairing 226 to define the walls of the flight chamber 201. For example, the panels 228 may be positioned on setting blocks to align the inner surfaces of the panels 228 with the inner surfaces of the fairings 226, retaining angles may be fastened to the top surfaces of the cover plates 227 on the opposite sides of the panels 228, and a structural adhesive may be applied in the channel between the retaining angles and the fairings 226 to secure the panels 228 in place. The panels 228 could be curved, flat or a mixture thereof depending on the desired cross-sectional geometry of the flight chamber 201 for the particular design. The panels 228 are generally made of a transparent material to allow observation of activities occurring within the flight chamber 201 from other areas of the wind tunnel facility.

It should be appreciated that the cable floor assembly 222 can be accessed for maintenance from under, rather than above, the weldments 224. In this way, the cover plates 227 need not be accessible or even necessarily sealed from the commercial areas surrounding the flight chamber 201. Instead, finished flooring (e.g., carpet, wood, tile, composite, etc.) may be installed over the cover plates 227 to provide a streamlined or minimalist aesthetic of the floor surrounding the flight chamber 201 to customers. For maintenance purposes, such as checking or replacing components of the cable floor assembly, the frame 220 may comprise walkways to facilitate access to the cables 223 and mounting plate 225 from beneath the weldment 224 (see FIG. 16). Further, the subfloor or basement area surrounding the fourth corner 209 is generally already vented to the airflow plenum through openings in a flyer staging area chamber adjacent the flight chamber entrance to equalize pressure therebetween, meaning this cable floor design would not affect the environmental conditions of this typically nonpublic area in a negative way. Further, base plates are not required to cover the bottom of the weldments or structurally mount the weldments to separate load-bearing crossbeams or other support elements of the wind tunnel facility structure, which further reduces construction/fabrication costs and simplifies the assembly process.

In certain embodiments of a dual-return recirculating wind tunnel, the height between the cables 223 and the bottom surface of the tunnel plenum thereunder (or base of the corner) is less than or equal to 1.3 times the diameter of the flight chamber. Stated another way: [the vertical distance between the cables and the base of the corner] is ≤[1.3×the diameter of the flight chamber]. In certain embodiments of single-loop recirculating wind tunnel, the height between the cables 223 and the bottom surface of the tunnel plenum thereunder (or base of the corner) is less than or equal to 1.9 times the diameter of the flight chamber. Stated another way: [the vertical distance between the cables and the base of the corner] is ≤[1.9×the diameter of the flight chamber].

Figure 25:
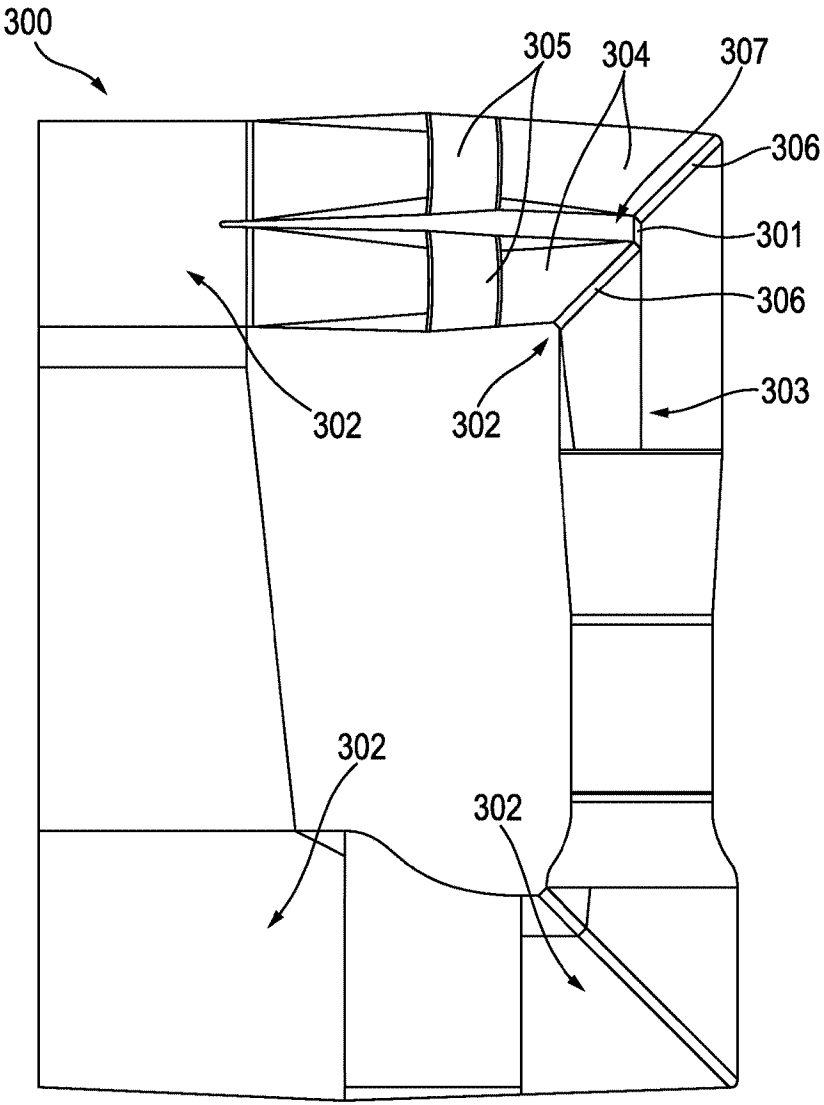
FIG. 25 shows a side view of a single-return recirculating wind tunnel having a stepped corner configuration.

Turning to FIGS. 25 (depicting a single-return flowpath) and 26 (depicting a dual-return flowpath), a recirculating wind tunnel 300 according to the present disclosure may further comprise a stepped turn 301 in one or more of the corners 302 of the wind tunnel 300. Although the stepped turn 301 is depicted in the first corner, it should be appreciated that the stepped turn 301 may be provided in other corners 302 of the wind tunnel as desired. The stepped turn 301 splits the flowpath of a plenum 303 into two or more flowpaths. In the depicted embodiments, the corner outlet flowpaths correspond to ducts 304 which contain fans 305 that generate the airflow through the wind tunnel 300. It should further be appreciated that the ducts 304 need not necessarily house fans 305. Turning vane structures 306 may be provided within the corner 302 at the inlet of each of the ducts 304 to redirect the airflow between the plenum 303 and the ducts 304. With this configuration, the stepped turn 301 diverges the airflow to provide space or clearance 307 between adjacent ducts 304. For example, the stepped turn 301 may be used to create adequate separation between the multiple individually-ducted fans 305, which can reduce the required tunnel flowpath length along the longitudinal axis through the ducts 304, since the fans 305 are able to be positioned closer to the corner 302 via the stepped turn 301. In other embodiments, the stepped turn 301 may create separation to accommodate and clear elements (e.g., structural beams/columns, vents, electrical wiring or the like) positioned within the space 307. Therefore, the dimensional footprint of the wind tunnel 300 can be reduced, which may enable wind tunnel constructions at locations with limited space. Likewise, the creation of the space or clearance 307 can provide additional freedom and options in facility design. Moreover, the advantages of the stepped turn 301 are not necessarily limited to vertical wind tunnels; horizontal wind tunnels could also utilize this stepped turn configuration to realize such benefits within the scope and spirit of the present disclosure.

Figure 30:
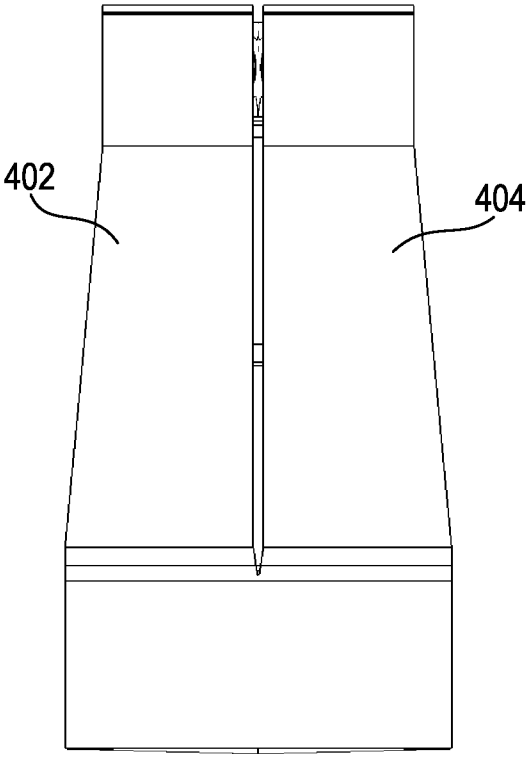
FIG. 30 shows a side view of the tunnel of FIG. 29.
Figure 29:
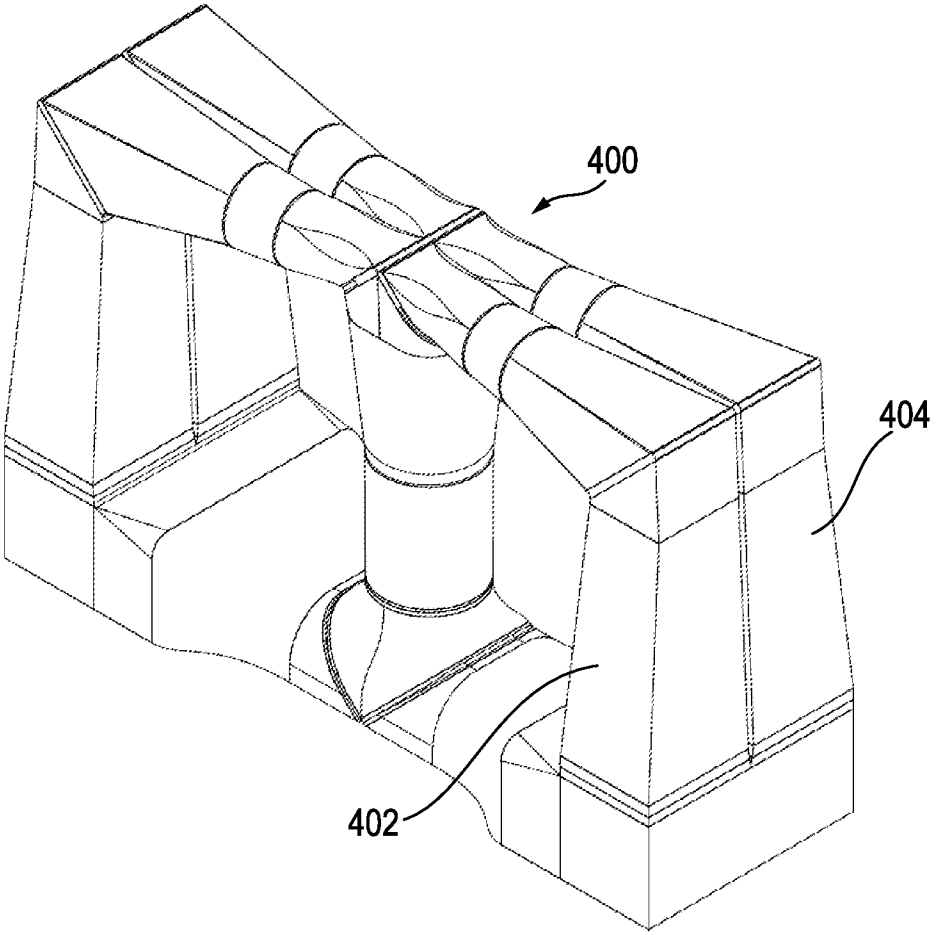
FIG. 29 shows a perspective view of another embodiment of a recirculating wind tunnel with a split return air tower.

Referring now to FIGS. 29 and 30, a further embodiment of a recirculating wind tunnel 400 according to the present disclosure is shown. As depicted, the wind tunnel 400 may be designed in the same manner as the above embodiments, meaning the above descriptions apply equally to this embodiment, except that the second corner and the vertical return plenum of the wind tunnel 400 are divided into more than one flowpath. The wind tunnel 400 comprises a first return air tower 402 and a second return air tower 404. The return air towers 402, 404 correspond to the second corner and the vertical return plenum. The return air towers 402, 404 provide separate parallel flowpaths for the airflow. Therefore, in this embodiment, the airflow is separated between each side or loop of the wind tunnel 400 at the first corner, and further between two flowpaths through the upper horizontal plenum, second corner, and vertical return plenum. The flowpaths of the return air towers 402, 404 may then be rejoined at the third corner. In the depicted embodiment, the return air towers 402, 404 are physically separated by a gap (see FIG. 30), but other embodiments may have a physical separation structure shared by both return air towers with no gap therebetween (e.g. a plenum divider wall that defines portions of both return air tower flowpaths). This division between the return air towers 402, 404 allows the vertical return plenum to expand more rapidly between the second and third corners (increase in cross-sectional area) without creating airflow separation from the plenum walls, which separation would result in increased turbulence, unsteadiness, and loss of efficiency. If the cross-sectional areas of the second and third corners are kept constant, the length of the vertical return plenum can therefore be decreased using the split return air towers 402, 404 compared to a single-flowpath vertical return plenum, without airflow wall separation, due to the improved wall divergence capacity over the same distance. The length decrease or height reduction of the vertical return plenum enables an overall height reduction of the tunnel 400 and, correspondingly, a facility housing the tunnel 400. The benefits of height reduction, discussed above with respect to the contracting corner, also apply here. It should be appreciated that the described separation of the return air towers 402, 404 may be incorporated in the wind tunnel 200 previously described.

Figure 32:
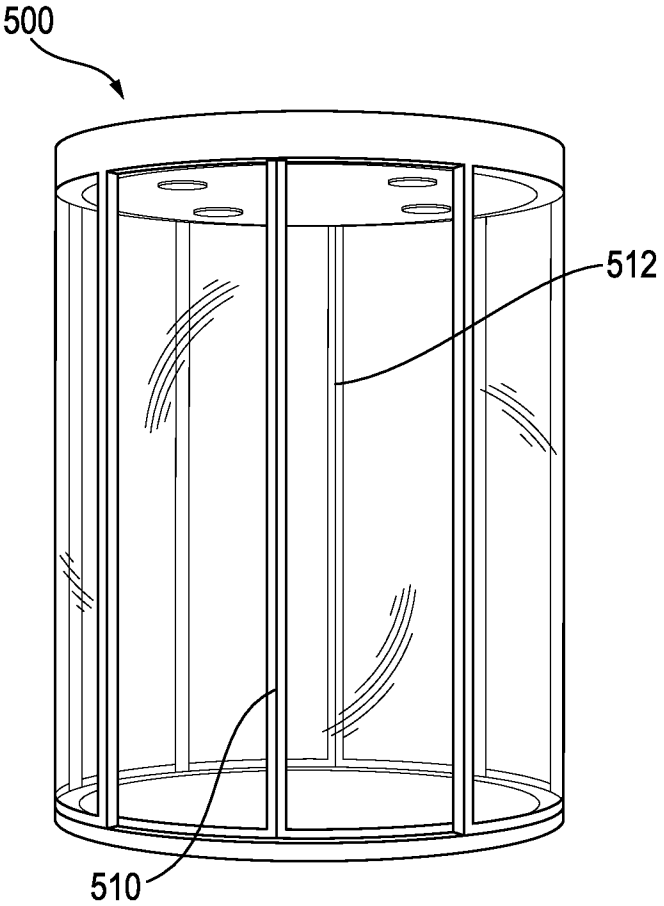
FIG. 32 shows a side perspective view of a flyer exchange device.
Figure 31:
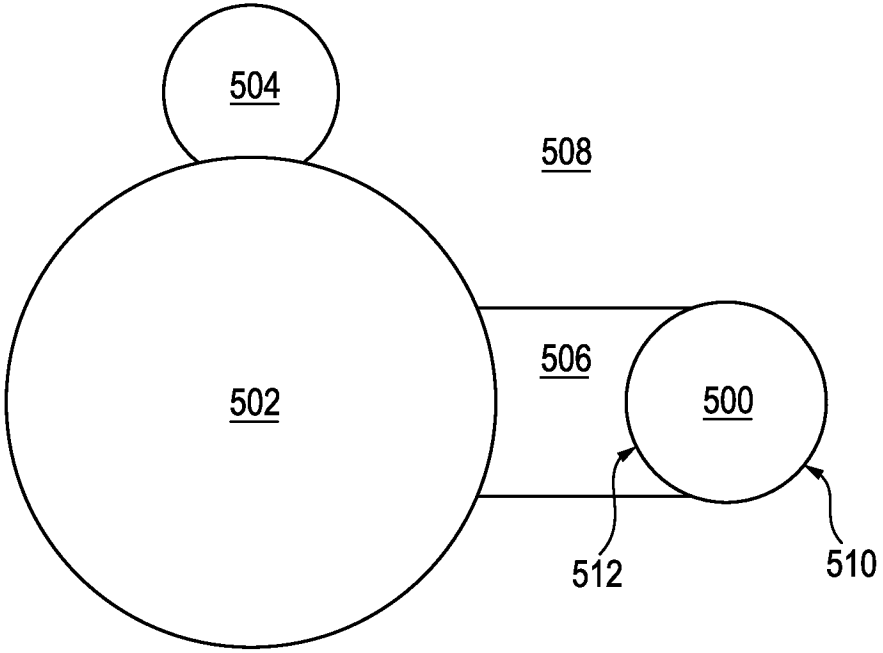
FIG. 31 is a schematic floor plan diagram of a wind tunnel facility with a flyer exchange device according to the present disclosure.

Referring now to FIGS. 31 and 32, a recirculating vertical wind tunnel according to the present disclosure may further comprise a flyer exchange system 500. FIG. 31 shows a schematic wind tunnel facility partial floor plan around the area of the flight chamber. The wind tunnel comprises a flight chamber 502 with a circular or substantially circular cross section wherein participants engage in indoor skydiving, although other embodiments may include differently shaped cross sections. A control room 504 is arranged adjacent to the flight chamber 502 wherein facility personnel may monitor flyer activity (e.g. if a participant is injured) and tunnel conditions (e.g. temperature, wind speed, etc.), and control tunnel systems as needed. An enclosed corridor 506 connects the flight chamber 502 to the flyer exchange device 500. For example, a participant may step through an open door frame formed in the wall of the flight chamber 502 to move between the corridor 506 and flight chamber 502. The corridor 506 is sealed from the surrounding observation area 508 of the facility. The flyer exchange device 500 comprises an enclosed chamber with two opposing doors. One of the doors, exterior door 510, is connected to the observation area 508. The other door, interior door 512, is connected to the corridor 506. When a participant wants to enter the wind tunnel, the exterior door 510 of the flyer exchange device 500 is opened first. The participant then enters through the exterior door 510 into the flyer exchange system 500 from the observation area 508. The exterior door 510 is then closed. Once the participant is inside the flyer exchange device 500 with the exterior door closed 510, the interior door 512 may then be opened. The participant then steps through the interior door 512 to exit the flyer exchange device 500 and enter into the corridor 506. At this point, the participant may proceed through the corridor 506 to enter the flight chamber 502. The interior door 512 may then be closed. Participants may exit the wind tunnel in the reverse process.

Operation of the doors 510, 512 may be automatic, manual, or both. For example, opening and/or closing may be operated by pushbutton or another input device from the operator control room 504. Likewise, pushbutton(s) or other input device(s) may be provided at the doors 510, 512 themselves for operation by participants, such as inside the flyer exchanger 500 and/or the corridor 506. Automated timed operation may also be used to control when the doors 510, 512 are opened and/or closed, as well as the sequence in which specific doors are opened and/or closed. Sensors may also be used for automated door operation. Still further, a RFID or bar/QR code reader may be provided proximate to the exterior door 510 to scan a wristband or keycard worn by the participant to confirm entry authorization before the exterior door 510 is opened.

Accordingly, it should be appreciated that the flyer exchange device 500 provides a controlled and continuous mechanism for the exchange of flyers between the flight chamber 502 and observation area 508. Pressure and noise exchange between the flight chamber 502 and observation area 508 is prevented or reduced via the two-door system. User access can be controlled and tracked via the authentication scanning methods. Further, views of the flight chamber 502 from the surrounding observation area 508 are less impeded compared to prior wind tunnel facilities having an entire staging area chamber for housing batches of participants extending around the flight chamber periphery. This aspect also frees up additional floor space for the observation area 508 adjacent to the flight chamber 502 for other uses.

Figure 33:
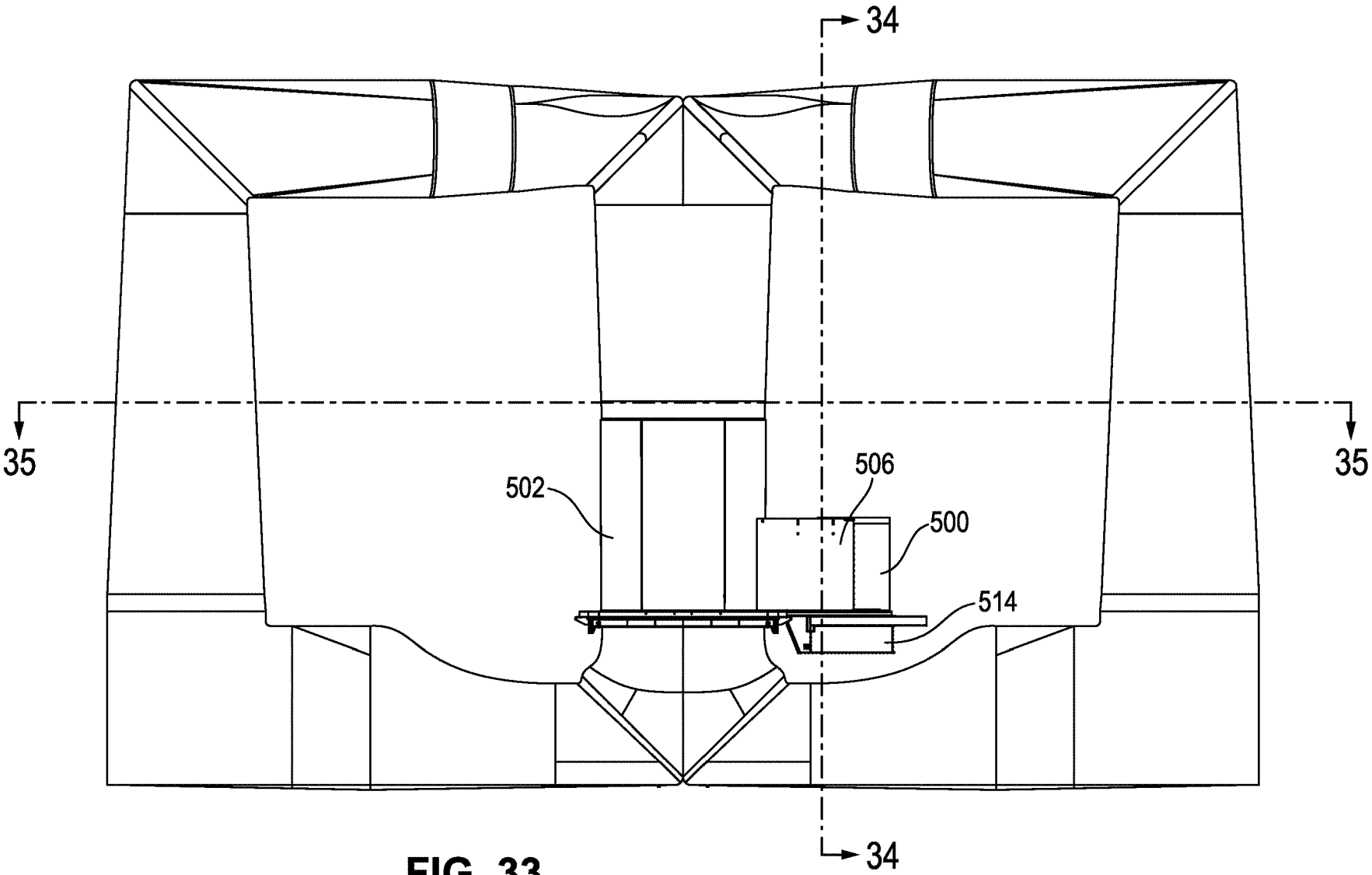
FIG. 33 shows a side view of a recirculating vertical wind tunnel according to the present disclosure with a flyer exchange system.
Figure 34:
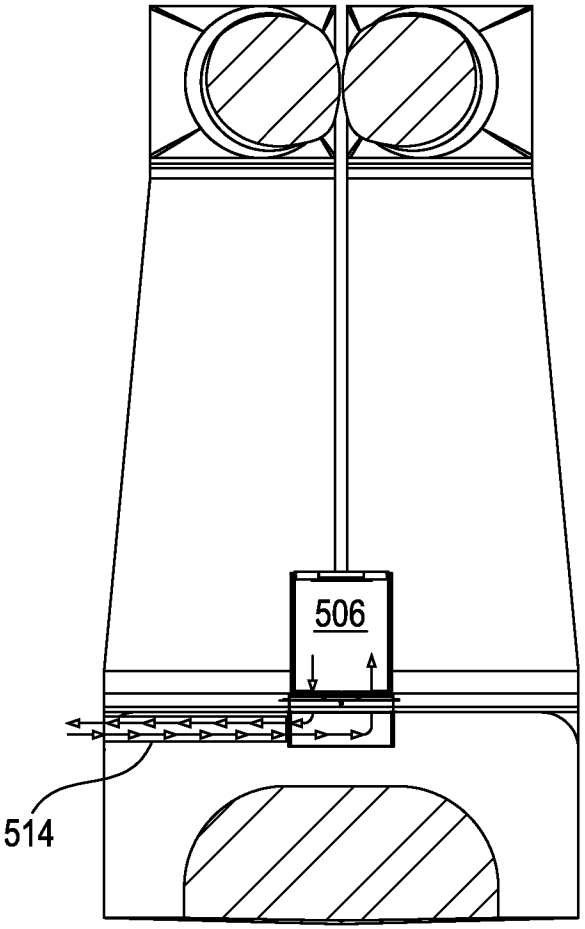
FIG. 34 shows a sectional view taken along line 34-34 of FIG. 33.
Figure 35:
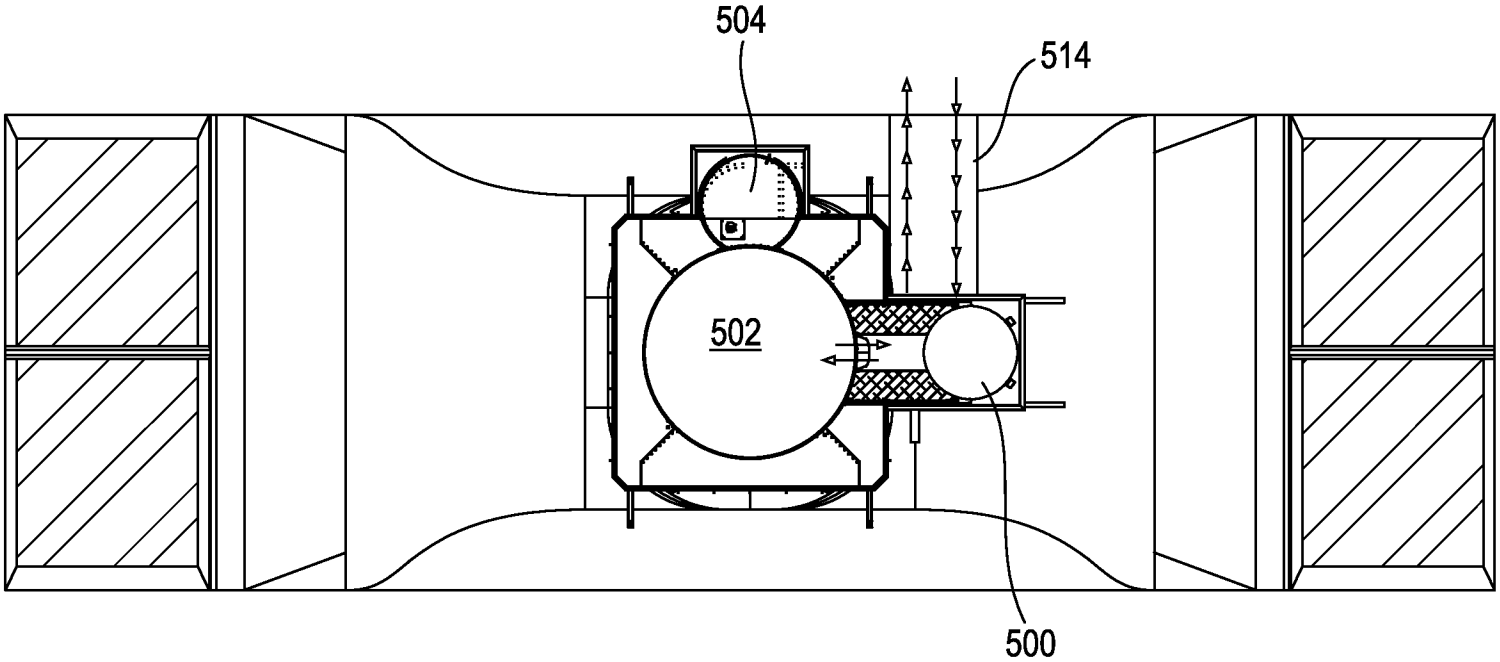
FIG. 35 shows a sectional view taken along line 35-35 of FIG. 33.

FIGS. 33 through 35 show an embodiment of a recirculating vertical wind tunnel according to the present disclosure with the flyer exchange system 500. The commercial floor of the facility (not shown) is located generally in line with the base of the flight chamber 502, corridor 506, and flyer exchange device 500. The commercial floor separates the space above it (e.g. the observation area 508 surrounding the flight chamber 502) from the space below it (e.g. areas around the contracting corner, lower horizontal plenum, etc.). As seen in FIGS. 34 and 35, the corridor 506 may be in aerodynamic communication with at least one atmospheric vent 514. For example, the floor of the corridor 506 may comprise one or more openings which connect the interior of the corridor 506 to the interior of the atmospheric vent 514. The atmospheric vent 514 may be in aerodynamic communication with the exterior environment of the building, or with the space beneath the commercial floor (e.g. areas around the contracting corner, lower horizontal plenum, etc.). In the depicted embodiment, the atmospheric vent 514 is a closed conduit that extends to connect to the outside of the building, rather than opening into the space beneath the commercial floor which can cause air drafts in this space. Airflow between the corridor 506 and atmospheric vent 514 is represented by lines with arrows in the drawings. Therefore, the pressure in the corridor 506 is equalized via the aerodynamic communication with the atmospheric vent 514. This reduces noise (e.g., pressure wave thudding) and improves the comfort of users within the corridor 506. In this embodiment with a vented corridor 506, the double doors 510, 512 of the flyer exchange device 500 act more to control user access and reduce noise exchange, rather than prevent pressure exchange, between the corridor 506 and the commercial or observation area 508.

While a number of aspects and embodiments have been discussed, those of skill in the art will recognize certain modifications, permutations, additions and sub-combinations therefor. It is thus intended that the following appended claims are interpreted to include all such modifications, permutations, additions and sub-combinations, which are within their true spirit and scope. Each embodiment described herein has numerous equivalents.

The terms and expressions which have been employed are used as terms of description and not of limitation, and there is no intention in the use of such terms and expressions of excluding any equivalents of the features shown and described or portions thereof; it being recognized that various modifications are possible within the scope of the invention claimed. Thus, it should be understood that although the present invention has been specifically disclosed by certain embodiments and optional features, modification and variation of the concepts disclosed herein may be resorted to by those skilled in the art, and that such modifications and variations are considered to be within the scope of this invention as defined by the appended claims. Whenever a range is given in the specification, all intermediate ranges and subranges, as well as all individual values included in the ranges given are intended to be included in the disclosure. When a Markush group or other grouping is used herein, all individual members of the group and all possible combinations and sub-combinations of the group are intended to be individually included in the disclosure.

In general, the terms and phrases used herein have their art-recognized meaning, which can be found by reference to standard texts, literature, journal references and contexts known to those skilled in the art. The above definitions are provided to clarify their specific use in the context of the invention.

LIST OF REFERENCE NUMERALS

100 wind tunnel
101 flight chamber
102 diffuser
103 first corner
104 upper horizontal plenum
105 second corner
106 vertical return plenum
107 third corner
108 lower horizontal plenum
109 fourth corner
110 inlet contractor
111 first section of lower horizontal plenum
112 second section of lower horizontal plenum
113 turning vanes
200 wind tunnel
201 flight chamber
202 diffuser
203 first corner
204 upper horizontal plenum
205 second corner
206 vertical return plenum
207 third corner
208 lower horizontal plenum
209 fourth or contracting corner
210 fans
211 first section of lower horizontal plenum
212 second section of lower horizontal plenum
213 corner transition portions
214 contracting corner arches
215 ridge
216 bottom surface or floor
217 low point of floor
218 contracting portion of second section
219 transition portion of second section
220 frame structure
221 turning vanes
222 cable floor assembly
223 cables
224 weldments
225 mounting plate
226 fairing
227 cover plate
228 flight chamber wall panel
229 eye bolt
230 compression spring
231 nut
232 washer
233 bushing
300 wind tunnel
301 stepped turn
302 corner
303 plenum
304 ducts
305 fans
306 turning vane structure
307 space or clearance
400 recirculating wind tunnel
402 first return air tower
404 second return air tower
500 flyer exchange system or device
502 flight chamber

504 control room
506 corridor
508 observation area
510 exterior door
512 interior door
514 vent

The invention claimed is:

1. A vertical wind tunnel for indoor skydiving comprising:

a recirculating airflow plenum;

a flight chamber housed within a first vertical member of the airflow plenum;

the recirculating airflow plenum including a top horizontal member, a bottom horizontal member, and a second vertical member;

a corner section arranged below the flight chamber and connecting the bottom horizontal plenum to the flight chamber, the corner section comprises a turning vane structure including a centerline and an arch;

wherein the bottom horizontal plenum has a first section and a second section extending from the second vertical member to the first vertical member, the first section connected to the second vertical member, the second section connected to the corner section;

the first section has a generally rectangular cross section;

the second section contracts the airflow between the first section and the corner section, the second section having an upper surface;

the walls of the second section comprising transitions between the first section and the corner section;

the corner section contracting the airflow between the second section and the flight chamber;

the walls of the corner section comprising transitions between the second section and the flight chamber, thereby reducing the height of the recirculating airflow plenum;

the upper surface of the second section having an arched shape substantially corresponding to the arch of the corner section extending from the centerline at least partially in the direction of the first section.

2. The vertical wind tunnel of claim 1, further comprising another bottom horizontal plenum, the corner section connects the flight chamber to each bottom horizontal plenum, and the turning vane structure has two arches.

3. The vertical wind tunnel of claim 1, wherein the first section comprises one or more corner transition portions, the one or more corner transition portions transition between a hard corner near the second vertical member to a rounded corner at the second section of the bottom horizontal plenum.

4. The vertical wind tunnel of claim 3, wherein the one or more corner transition portions extend along at least a majority of the length of the first section.

5. The vertical wind tunnel of claim 3, wherein the one or more corner transition portions are formed by the walls of the first section.

6. The vertical wind tunnel of claim 3, wherein the one or more corner transition portions are formed by separate structures mounted within the first section.

7. The vertical wind tunnel of claim 1, wherein the flight chamber comprises a round or substantially round cross section at the joint with the corner section.

8. The vertical wind tunnel of claim 1, wherein the walls of the corner section form an inlet contractor oriented vertically around the central axis of the flight chamber between the turning vane structure and the flight chamber.

9. The vertical wind tunnel of claim 8, wherein the inlet contractor is directly mounted to the one or more arches of the turning vane structure.

10. The vertical wind tunnel of claim 1, wherein the bottom horizontal plenum is directly connected to an arch of the one or more arches of the turning vane structure.

11. The vertical wind tunnel of claim 1, wherein the one or more arches of the turning frame structure at least partially define the recirculating airflow plenum through the corner section.

12. The vertical wind tunnel of claim 1, wherein the walls of the corner section at least partially form an S-shaped double curvature profile between the flight chamber and the one or more arches of the turning vane structure.

13. The vertical wind tunnel of claim 1, wherein the corner section connects the flight chamber to two bottom horizontal plenums, and the cross-sectional area of the corner section between the two bottom horizontal plenums and the flight chamber contracts at a ratio of approximately 2:1.

14. The vertical wind tunnel of claim 1, wherein the corner section connects the flight chamber to two bottom horizontal plenums, and the recirculating airflow plenum through the corner section has a semi-oval cross section at each of the two bottom horizontal plenums to a round or substantially round cross section at the flight chamber.

15. The vertical wind tunnel of claim 1, wherein the one or more arches span between the ends of the centerline and incline upwards.

16. The vertical wind tunnel of claim 15, wherein each arch of the one or more arches of the turning frame structure is inclined upward approximately 45 degrees with respect to the horizontal plane.

17. The vertical wind tunnel of claim 1, wherein the one or more arches of the turning vane structure include a first arch and a second arch, the first arch extending in an opposite direction of the second arch.

18. The vertical wind tunnel of claim 1, wherein the turning vane structure includes turning vanes extending across each arch of the one or more arches of the turning vane structure, the turning vanes configured to redirect airflow from the bottom horizontal plenum upward to the flight chamber.

19. The vertical wind tunnel of claim 1, wherein the turning vane structure provides structural support to one or more plenum structures of the vertical wind tunnel.

20. The vertical wind tunnel of claim 1, wherein the centerline of the turning vane structure comprises a ridge having a curved surface which transitions between being horizontal or substantially horizontal to vertical or substantially vertical.

21. The vertical wind tunnel of claim 1, wherein the turning vane structure includes a frame structure provided outside the recirculating airflow plenum, and the one or more arches of the turning vane structure are attached to the frame structure.

22. The vertical wind tunnel of claim 21, wherein a cable floor assembly is mounted to the frame structure of the turning vane structure, the cable floor assembly including a plurality of cables extending across the flight chamber.

23. The vertical wind tunnel of claim 1, wherein the walls of the second section of the bottom horizontal plenum form an inlet contractor oriented horizontally between the corner section and the first section of the bottom horizontal plenum.

24. The vertical wind tunnel of claim 1, wherein the recirculating airflow plenum through the second section of the bottom horizontal plenum comprises a generally rectangular cross section near the first section and a semi-oval or substantially semi-oval cross section near the corner section.

* * * * *